US010496024B2

(12) United States Patent
Suzuki

(10) Patent No.: US 10,496,024 B2
(45) Date of Patent: Dec. 3, 2019

(54) DECOLORIZATION APPARATUS, IMAGE FORMING APPARATUS, AND DECOLORIZATION METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Katsunori Suzuki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/935,124

(22) Filed: Mar. 26, 2018

(65) Prior Publication Data

US 2019/0294096 A1 Sep. 26, 2019

(51) Int. Cl.
*G03G 15/20* (2006.01)
*G03G 15/00* (2006.01)

(52) U.S. Cl.
CPC ..... *G03G 15/6585* (2013.01); *G03G 15/205* (2013.01); *G03G 15/5062* (2013.01);
(Continued)

(58) Field of Classification Search
CPC ..... G03G 15/5062; G03G 15/0126; G03G 15/205; G03G 15/6585;
(Continued)

(56) References Cited

U.S. PATENT DOCUMENTS 9,821,590 B2 * 11/2017 Takeda ..... H04N 1/00803
2011/0222937 A1 * 9/2011 Yahata ..... G03G 15/6502 399/341

(Continued)

FOREIGN PATENT DOCUMENTS

JP 10-97112 4/1998
JP 2003-316206 11/2003

(Continued)

*Primary Examiner* — Robert B Beatty
(74) *Attorney, Agent, or Firm* — Amin, Turocy & Watson, LLP

(57) ABSTRACT

An image forming apparatus according to an embodiment includes an image acquisition unit, a heating unit, a presence-or-absence-of-an-image determination unit, an image formation unit, a determination unit, and a heating control unit. The image acquisition unit reads an image on a sheet. The heating unit heats the sheet. Based on the image that is read by the image acquisition unit, the presence-or-absence-of-an-image determination unit determines whether the image is printed on the sheet. The image formation unit forms the image on the sheet using a decolorable toner that is decolorized by heating the sheet to a prescribed temperature and a non-decolorable toner that is not decolorized although the sheet is heated. The determination unit determines whether to supply power to the heating unit, depending on an instruction which the decolorable toner is decolorized and on determination by the presence-or-absence-of-an-image determination unit whether the image is printed on the sheet.

15 Claims, 27 Drawing Sheets

(52) U.S. Cl.
CPC ..... *G03G 2215/00531* (2013.01); *G03G 2215/209* (2013.01)

(58) Field of Classification Search
CPC ..... G03G 2215/00531; G03G 2215/00708; G03G 2215/00789; G03G 2215/0624; G03G 2215/209
USPC ..... 399/15, 69, 223, 405
See application file for complete search history.

(56) References Cited

U.S. PATENT DOCUMENTS

| | | | | |
|---|---|---|---|---|
| 2014/0199103 | A1* | 7/2014 | Terada | G03G 21/00 399/341 |
| 2016/0077473 | A1* | 3/2016 | Ise | B65H 1/28 399/322 |
| 2018/0067424 | A1* | 3/2018 | Mizutani | G03G 15/6582 |
| 2018/0229530 | A1* | 8/2018 | Iwamoto | G03G 15/2039 |

FOREIGN PATENT DOCUMENTS

| | | | | |
|---|---|---|---|---|
| JP | 2010-271555 | | 12/2010 | |
| JP | 2010271555 | A * | 12/2010 | |
| JP | 2010276664 | A * | 12/2010 | |
| JP | 2014-153504 | | 8/2014 | |
| JP | 2015075757 | A * | 4/2015 | G06K 15/1806 |

* cited by examiner

FIG. 7

D110

D111

| DETERMINATION CONDITION | | | TRANSPORTATION PATH | PRINTING PROCESSING |
|---|---|---|---|---|
| INPUT INSTRUCTION | PRESENCE OR ABSENCE OF IMAGE | TYPE OF TONER | | |
| PRINTING | ABSENCE | – | FIRST PRINTING-TIME TRANSPORTATION PATH | HEATING |
| PRINTING | PRESENCE | NON-DECOLORABLE | SECOND PRINTING-TIME TRANSPORTATION PATH | NON-HEATING |
| PRINTING | PRESENCE | DECOLORABLE | THIRD PRINTING-TIME TRANSPORTATION PATH | NON-HEATING |
| DECOLORABLE | PRESENCE | DECOLORABLE | FIRST DECOLORIZATION-TIME TRANSPORTATION PATH | HEATING |
| DECOLORABLE | PRESENCE | NON-DECOLORABLE | SECOND DECOLORIZATION-TIME TRANSPORTATION PATH | NON-HEATING |
| DECOLORABLE | ABSENCE | – | THIRD DECOLORIZATION-TIME TRANSPORTATION PATH | NON-HEATING |

DECOLORIZATION APPARATUS, IMAGE FORMING APPARATUS, AND DECOLORIZATION METHOD

FIELD

Embodiments described herein relate generally to a decolorization apparatus, an image forming apparatus, and a decolorization method.

BACKGROUND

A toner (hereinafter referred to as a "decolorable toner) in the related art that is decolorized by being heated to a prescribed temperature or above is developed. An image forming apparatus that possibly performs printing which uses the decolorable toner and printing which uses a toner (hereinafter referred to as a "non-decolorable toner") that is not decolorized is developed. Additionally, there is also an image forming apparatus that has a function of decolorizing an image that is printed using the decolorable toner.

For example, this image forming apparatus includes a first tray in which a sheet on which an image is not printed is placed and a second tray in which a sheet on which an image is printed is placed. The image forming apparatus performs processing that prints an image, on the sheet that is placed in the first tray, according to a user input. The image forming apparatus performs processing that decolorizes the image, on the sheet that is placed in the second tray, according to the user input.

However, in this image forming apparatus, there is a case where the sheet on which the image is printed is placed in the first tray by a user's mistake. In this case, the image forming apparatus prints a new image on the sheet on which the image is printed. Generally, because a user does not desire this printing, the energy consumed for this printing processing does down the drain. Furthermore, in the image forming apparatus, there is a case where a sheet on which an image is not printed is placed in the second tray by the user's mistake. In this case, the image forming apparatus performs processing that decolorizes an image on the sheet on which a decolorization-target image is not formed. The performance of this processing is a waste of energy. There is a case where, in this manner, the image forming apparatus in the related art consumes energy unnecessarily in printing an image or performing decolorization.

DESCRIPTION OF THE DRAWINGS

FIG. 7 is a diagram illustrating a specific example of operational information according to the first embodiment.

DETAILED DESCRIPTION

An image forming apparatus according to an embodiment includes an image acquisition unit, a heating unit, a presence-or-absence-of-an-image determination unit, an image formation unit, a determination unit, and a heating control unit. The image acquisition unit optically reads an image on a sheet. The heating unit heats the sheet. Based on the image that is read by the image acquisition unit, the presence-or-absence-of-an-image determination unit determines whether or not the image is printed on the sheet. The image formation unit forms an image on a sheet using one or both of the decolorable toner that is decolorized by heating the sheet to a prescribed temperature or above and the non-decolorable toner that is not decolorized although the sheet is heated to the prescribed temperature or above. The determination unit determines whether or not to supply power for heating the sheet to the heating unit. Based on the determination by the determination unit, the heating control unit controls the heating unit. The determination unit determines whether or not to supply the power for heating the sheet to the heating unit, depending on determination of whether or not an instruction for the sheet to be heated by the heating unit to a temperature at which the decolorable toner is decolorized is input and on determination by the presence-or-absence-of-an-image determination unit of whether or not the image is printed on the sheet.

First Embodiment

Figure 1:
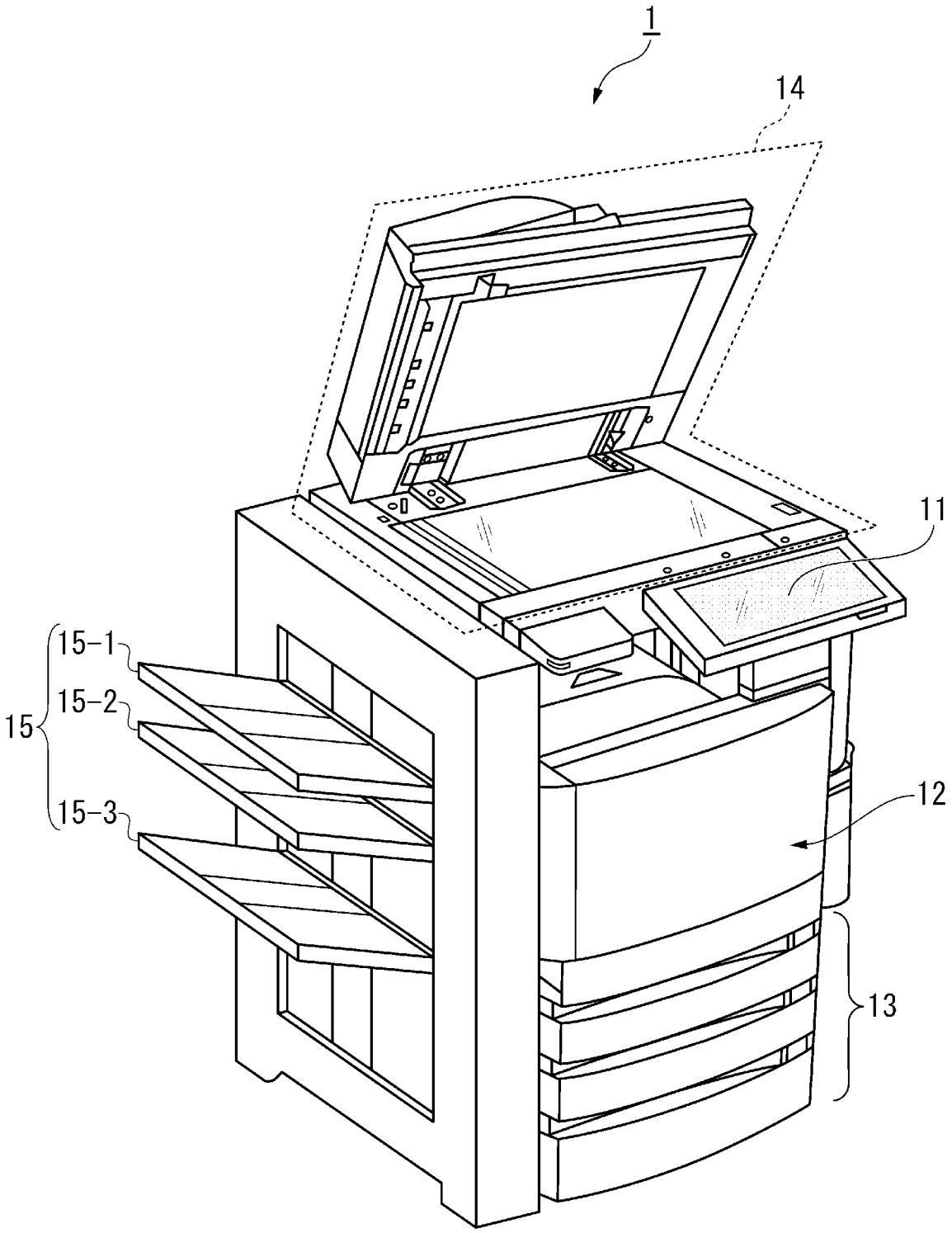
FIG. 1 is an external appearance diagram illustrating an example of an entire configuration of an image forming apparatus according to a first embodiment.

FIG. 1 is an external appearance diagram illustrating an example of an entire configuration of an image forming apparatus 1 according to a first embodiment. The image forming apparatus 1, for example, is a multi-function machine. The image forming apparatus 1 includes a touch panel 11, a printing unit 12, a sheet accommodation unit 13, an image reading unit 14, and a paper sheet discharging unit 15.

It is noted that the image formation unit 121 of the image forming apparatus 1 may be an apparatus that causes a toner image to be fixed and may be an ink jet-type apparatus.

The image forming apparatus 1 forms an image on a sheet using a developing agent such as a toner. The sheet, for example, is a sheet of paper or a label. The sheet may be any material as long as the image forming apparatus 1 can form an image on a surface of the sheet.

The touch panel 11 includes a display 111 and a control panel 112. The display 111 is an image display apparatus, such as a liquid crystal display or an organic electro luminescence (EL) display. Displayed on the display 111 are various pieces of information relating to the image forming apparatus 1.

The control panel 112 has a plurality of buttons. A user operation is performed on the control panel 112. The control panel 112 outputs a signal in accordance with the operation that is performed by a user, to a control unit of the image forming apparatus 1.

The printing unit 12 prints an image on a sheet, based on image information that is generated by the image reading unit 14, or image information that is received through a communication path. The details will be described below.

The sheet accommodation unit 13 accommodates a sheet that is used for the printing of an image (which is referred to as "image printing") in the printing unit 12.

The paper sheet discharging unit 15 discharges the sheet on which image printing processing is performed by the printing unit 12. The paper sheet discharging unit 15 includes paper discharge trays 151-1 to 151-3. The paper discharge trays 151-1 to 151-3 are trays on which sheets are placed. The paper discharge trays 151-1 to 151-3, if not individually distinguished, are hereinafter referred to as the paper discharge tray 151. The paper sheet discharging unit 15 does not necessarily need to include three trays. The paper sheet discharging unit 15, for example, may include two trays and may include one tray. Four trays may be included.

The image reading unit 14 read reading-target image information as light brightness and darkness. The image reading unit 14 records the image information that is read. The image information that is recorded may be transmitted to another information processing apparatus through a network. The recorded image information may be printed by the printing unit 12 on a sheet.

Figure 2:
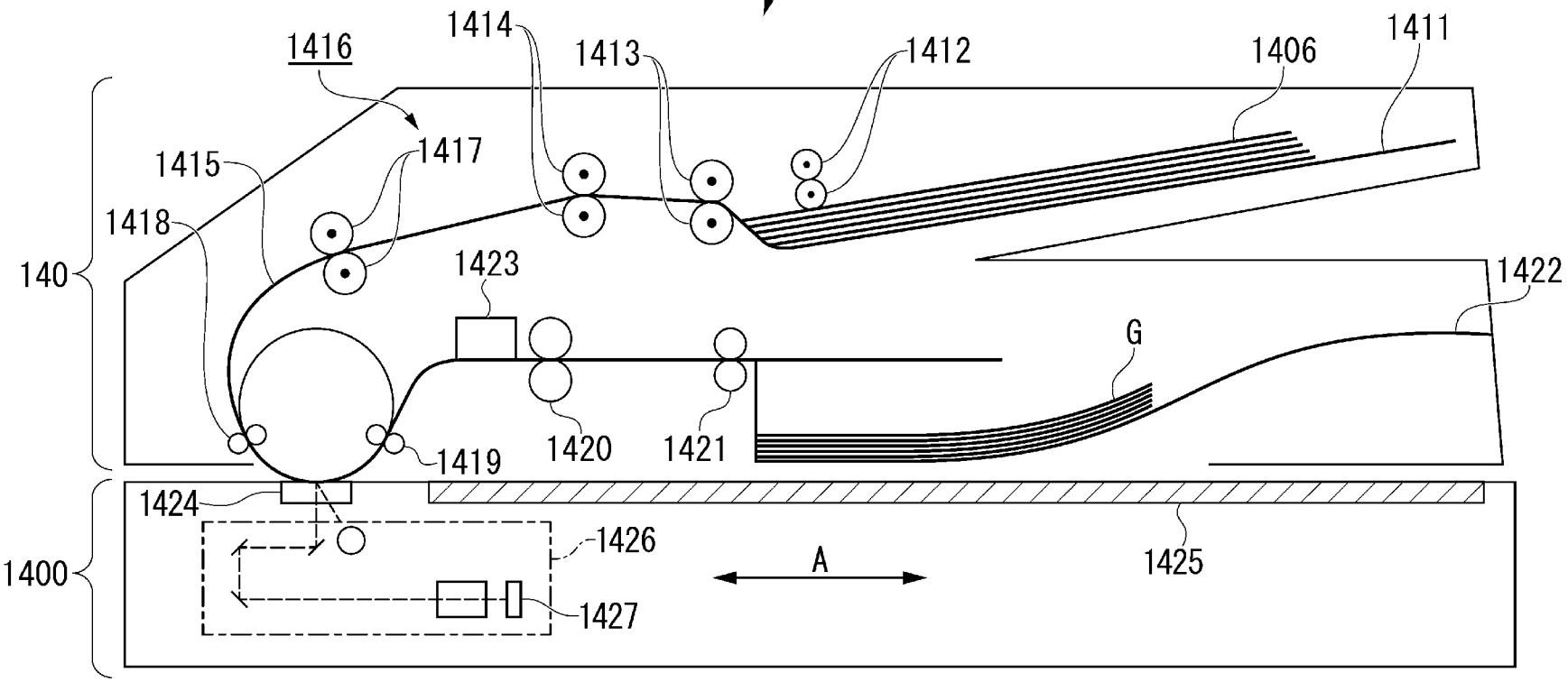
FIG. 2 is a diagram illustrating a specific example of a configuration of an image reading unit in the first embodiment.

FIG. 2 is a diagram illustrating a specific example of a configuration of the image reading unit 14 in the first embodiment.

The image reading unit 14 has a scanner 1400 and an auto document feeder (ADF) 140 that transports an original document G to the scanner 1400.

The scanner 1400 includes a reading window glass pane 1424, a platen glass pane 1425, an optical mechanism 1426, and a charge coupled device (CCD) 1427 that is a first image reading sensor.

The reading window glass pane 1424 is an opening portion for the CCD 1427 to read an image on the original document G that is transported by the ADF 140. The platen glass pane 1425 is an original document placing stand on which the original document G is placed. The optical mechanism 1426 outputs reflection light that is reflected from the original document G which moves on the reading window glass pane 1424, to the CCD 1427. The optical mechanism 1426 moves along the platen glass pane 1425 in the direction of an arrow A (refer to FIG. 2) by a moving unit that is not illustrated. The optical mechanism 1426 outputs the reflection light from the original document G that is placed on the platen glass pane 1425, to the CCD 1427. The CCD 1427 photoelectrically converts an optical signal that is incident from the optical mechanism 1426 into an electrical signal, and outputs image information that denotes the image on the original document G. The image information is information denoting an image.

The CCD 1427 includes a plurality of reading elements that are arranged side by side in the main scanning line direction, and functions as an image reading sensor. Based on a horizontal synchronization signal that is input, the CCD 1427 acquires a signal for an image that corresponds to one line, by reading the original document G at the same time using a plurality of reading elements, and thus outputs the acquired signal as a reading signal. Furthermore, when the next horizontal synchronization signal is input, the CCD 1427 reads an image that corresponds to the next one line, and outputs a reading signal that results from the reading. In this manner, the CCD 1427 reads images that correspond to a plurality of lines, along sub-scanning lines, and sequentially outputs a reading signal for an image that corresponds to one line, which results from reading the original document G in the main scanning line direction. It is noted that the main scanning line direction is a direction that orthogonally intersects a direction in which the ADF 140 transports the original document G. A sub-scanning line direction is a direction that is parallel to the direction in which the ADF 140 transports the original document G. The main scanning line direction or the sub-scanning line direction is also referred to as a scanning line direction.

The ADF 140 includes an original tray 1411, a transportation mechanism 1416, and a paper discharge tray 1422. The transportation mechanism 1416 has a pickup roller 1412, a separation paper feeding roller 1413, a resistance roller 1414, an intermediate roller 1417, a pre-reading roller 1418, a post-reading roller 1419, a pre-paper-discharging roller 1420, and a paper discharge roller 1421. A path along which the original document G is transported by the transportation mechanism 1416 is a transportation path 1415.

The original document G that is a target for reading by the scanner 1400 is placed on the original tray 1411. The pickup roller 1412 takes out the original document G from the original tray 1411, and sends out toward the transportation path 1415. If a plurality of original documents G are taken out by the pickup roller 1412, the separation paper feeding roller 1413 separates the plurality of original documents G and sends out the separated original documents G. Accordingly, the separation paper feeding roller 1413 can prevent the original documents G from being sent in a stacked state (double feed). The resistance roller 1414 aligns a leading position of the original document G that is transported from the separation paper feeding roller 1413, and sends out the original documents G of which the leading position is aligned, toward the intermediate roller 1417. The pre-reading roller 1418 transports the original document G that is transported from the intermediate roller 1417, toward the reading window glass pane 1424. The post-reading roller 1419 discharges the original document G that is transported from the reading window glass pane 1424, toward a downstream position. The pre-paper-discharging roller 1420 sends out the original document G that is transported from the post-reading roller 1419, toward the paper discharge roller 1421. The paper discharge roller 1421 sends out the original document G that is transported from the post-reading roller 1419, toward the paper discharge tray 1422.

A contact image sensor (CIS) 1423 that is a second image reading sensor is provided somewhere between the post-reading roller 1419 to the pre-paper-discharging roller 1420. The CIS 1423 is provided in a second reading position. The second reading position, for example, is a position in a direction opposite to a first side of the original document G in a first position, which read by the CCD 1427, and is a position in which the CIS 1423 reads a second side of the original document G. The second reading position, for example, may be on a transportation path that runs from the pre-reading roller 1418 to the post-reading roller 1419. Based on the reflection light from the original document G, the CIS 1423 optically converts an optical signal into an electrical signal, and outputs the resulting image information. The CIS 1423 includes a plurality of reading elements that are arranged side by side in the main scanning line direction, and functions as an image reading sensor.

Based on the horizontal synchronization signal that is input, the CIS 1423 outputs reading signals that are read by a plurality of reading elements at the same time, as a reading signal for an image that corresponds to one line. Furthermore, when the next horizontal synchronization signal is input, the CIS 1423 reads an image that corresponds to the next one line, and outputs a reading signal that results from the reading. In this manner, the CIS 1423 reads images that correspond to a plurality of lines, along sub-scanning lines, and sequentially outputs a reading signal for an image that corresponds to one line, which results from reading the original document G in the main scanning line direction.

In the embodiment, the CCD 1427 that is the first image reading sensor reads an image on a surface that is the first side of the original document G that moves on a glass surface of the reading window glass pane 1424. The CIS 1423 that is the second image reading sensor reads an image on a rear surface that is the second side of the original document G that moves in the second reading position. Accordingly, the image reading unit 14 causes the original document G to pass along the transportation path 1415 only one time, and thus can read the surface image and the rear surface image from both the sides of the original document G. The surface image is a first side image. Furthermore, the rear surface image is a second side image.

Figure 3:
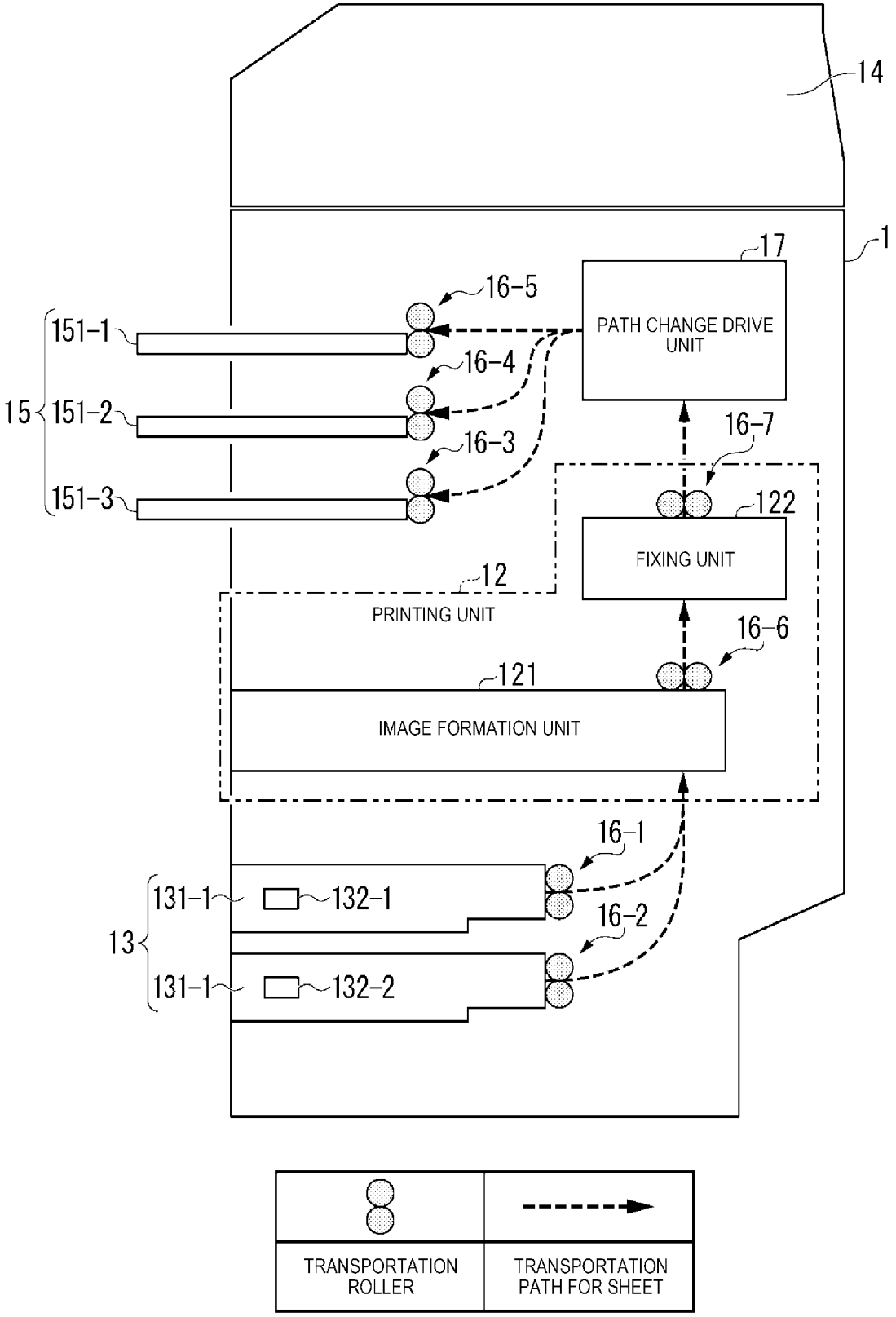
FIG. 3 is a diagram illustrating a specific example of a cross section of the image forming apparatus according to the first embodiment.

FIG. 3 is a diagram illustrating a specific example of a cross section of the image forming apparatus 1 according to the first embodiment. The image forming apparatus 1 includes the printing unit 12, the sheet accommodation unit 13, the image reading unit 14, the paper sheet discharging unit 15, a transportation roller 16-N (N is an integer that ranges from 1 to 5), and a path change drive unit 17. A description of a functional unit that is illustrated in FIG. 1 is hereinafter omitted.

The printing unit 12 includes the image formation unit 121 and a fixing unit 122. Based on the image information that is generated by the image reading unit 14 or the image information that is received through the communication path, the image formation unit 121 forms a toner image on a sheet using a toner.

Figure 4:
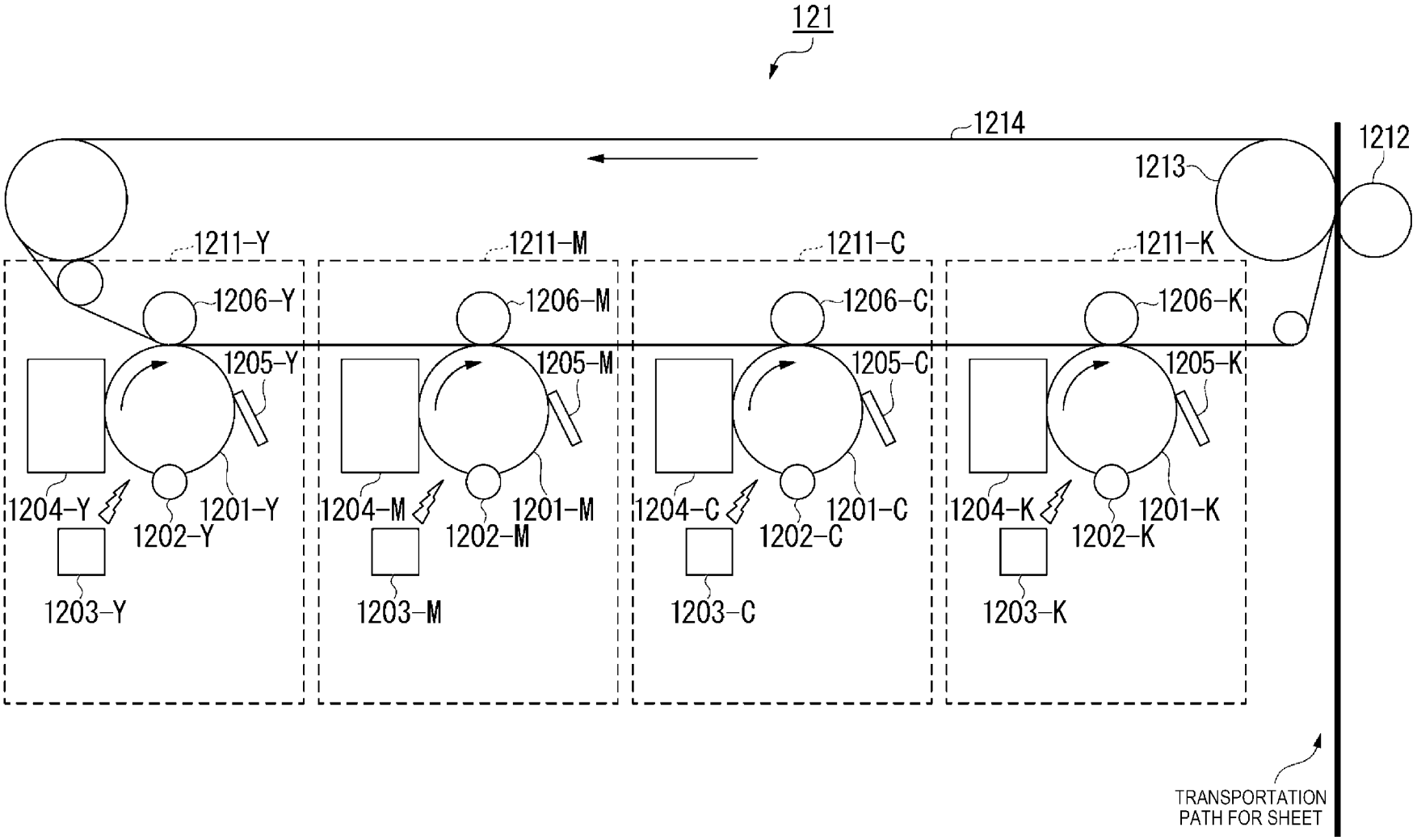
FIG. 4 is a diagram illustrating a specific example of a configuration of an image formation unit in the first embodiment.

FIG. 4 is a diagram illustrating a specific example of a configuration of the image formation unit 121 in the first embodiment.

The image formation unit 121 includes a process unit 1211, a secondary transfer roller 1212, a secondary transfer counter roller 1213 for every toner color. In FIG. 2, functional units that correspond to yellow, magenta, cyan, and black pigments, respectively, are distinguished by adding Y, M, C, and K to codes, respectively. For example, 1211-Y indicates the process unit 1211 that uses a yellow toner.

The process unit 1211 forms a toner shape on an intermediate transfer belt 1214 that is an endless belt. The process unit 1211 includes a photoconductive drum 1201, a charger 1202, a light exposure device 1203, a development device 1204, a photoconductive cleaner 1205, and a primary transfer roller 1206. In FIG. 2, as is the case with the process unit 1211, the functional units that correspond to yellow, magenta, cyan, and black pigments, respectively, are distinguished using Y, M, C, and K, respectively. For example, 1211-M indicates the photoconductive drum 1201 for magenta.

The photoconductive drum 1201 generates an electrostatic latent image on the surface thereof. The photoconductive drum 1201 is an image carrier, and is, for example, a drum in the shape of a cylinder. The photoconductive drum 1201 has a photoconductive material in the outer peripheral surface thereof. The property of the photoconductive drum 1201 is that a portion thereof that is exposed to light emit static electricity. The charger 1202 causes a surface of the photoconductive drum 1201 to be charged with the static electricity. The charger 1202, for example, is a needle electrode. The light exposure device 1203 forms an electrostatic latent image of a formation-target image on the surface of the photoconductive drum 1201. The light exposure device 1203, for example, is a laser irradiation device. The development device 1204 supplies a toner to the surface of the photoconductive drum 1201, and develops the electrostatic latent image using the toner. The photoconductive cleaner 1205 removes a residual toner of the photoconductive drum 1201. The primary transfer roller 1206 transfers the electrostatic latent image that is developed on the photoconductive drum 1201, to the intermediate transfer belt 1214.

The secondary transfer roller 1212 transfers the toner image on the intermediate transfer belt 1214 to the sheet. The secondary transfer counter roller 1213 is present in a position that faces the secondary transfer roller 1212 with the intermediate transfer belt 1214 being interposed between the secondary transfer counter roller 1213 itself and the secondary transfer roller 1212, interposes the sheet between the secondary transfer counter roller 1213 itself and the secondary transfer roller 1212, and transports the sheet to which the image is transferred.

The image formation unit 121 may include a toner cartridge for the non-decolorable toner. The image formation unit 121 may not only form the image using the decolorable toner, but may also form the image that uses the non-decolorable toner, with the process unit 1211-K as a process unit that can perform image formation using the non-decolorable toner. Alternatively, a setting may be provided in such a manner that, by adding a process unit that can perform the image formation using a non-decolorable toner for black, for example, to four process units that are illustrated in FIG. 4, the image formation can be performed using two or more different toners that includes the non-decolorable toner and the decolorable toner.

A description is provided with reference again to FIG. 3. The fixing unit 122 heats the sheet on which the toner image is formed by the image formation unit 121, and fixes the toner image on the sheet to the sheet.

Figure 5:
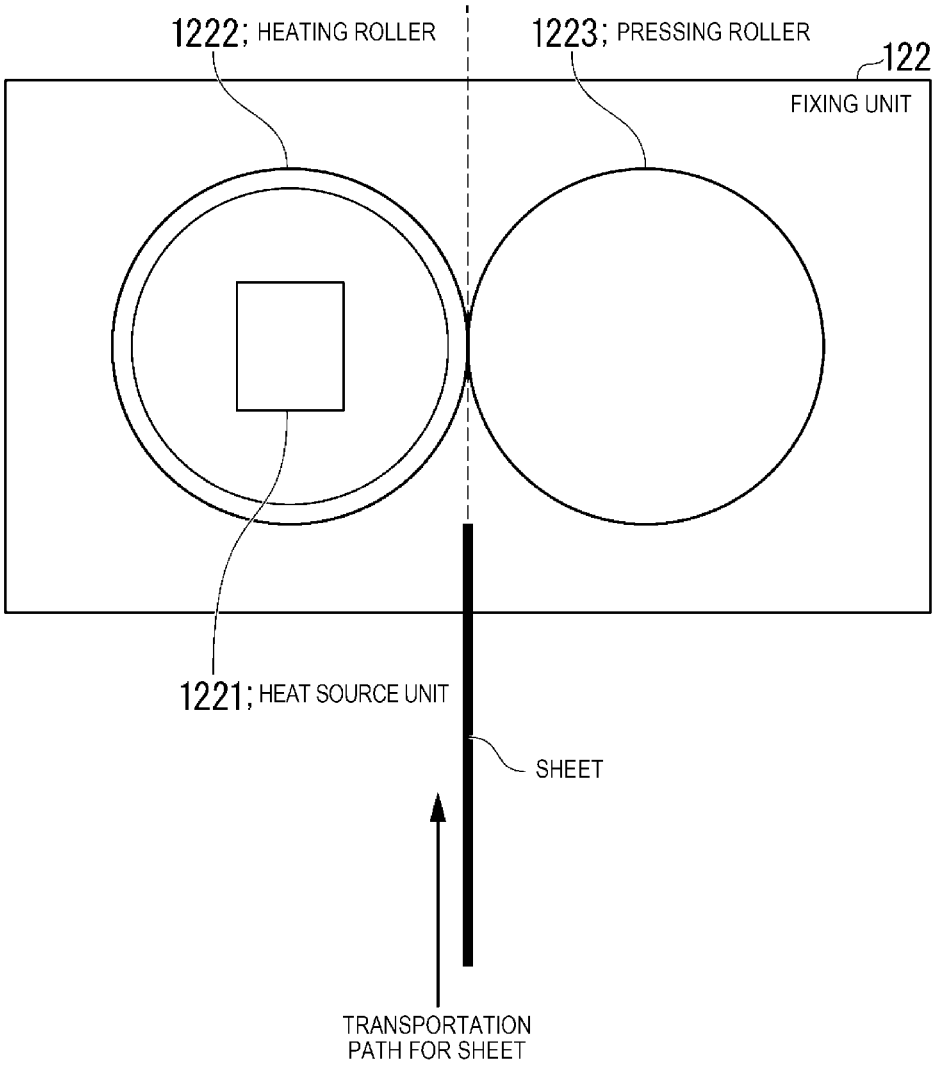
FIG. 5 is a diagram illustrating a specific example of a configuration of a fixing unit in the first embodiment.

FIG. 5 is a diagram illustrating a specific example of a configuration of the fixing unit 122 in the first embodiment.

The fixing unit 122 includes a heat source unit 1221, a heating roller 1222, and a pressing roller 1223. The sheet passes between the heating roller 1222 and the pressing roller 1223. The heating roller 1222 is heated by the heat source unit 1221. The toner that is transferred to the sheet is fixed to the sheet due to the heat that is emanated from the heating roller 1222. The pressing roller 1223 is forcibly pushed by a spring, which is not illustrated, to the heating roller 1222. The heat source unit 1221 may be any heat source as long as the heat source possibly heats the sheet up to a decolorization temperature at which the decolorable toner is decolorized and a fixing temperature at which the toner is fixed. For example, the heat source unit 1221 may be a halogen lamp, an IH heater, or the like. A thermal head can be employed instead of the heating roller 1222.

A description is provided with reference again to FIG. 3. The sheet accommodation unit 13 includes accommodation trays 131-1 and 131-2. The accommodation trays 131-1 and 131-2 accommodate the sheet. The accommodation tray 131-1 accommodates the sheet that is used for the printing of the image. The accommodation tray 131-2 accommodates the sheet on which the image is printed by the decolorable toner. The accommodation trays 131-1 and 131-2, if not individually distinguished, are hereinafter referred to as the accommodation tray 131. The accommodation tray 131-1 includes an image acquisition unit 132-1. The accommodation tray 131-2 includes an image acquisition unit 132-2. The image acquisition units 132-1 and 132-2, if not individually distinguished, are hereinafter referred to as the image acquisition unit 132. The image acquisition unit 132 acquires the image on the sheet by optically reading the sheet.

The image acquisition unit 132 generates image information that denotes the acquired image on the sheet. The image acquisition unit 132 may be any image acquisition unit as long as the image acquisition unit possibly acquires the image on the sheet. The image acquisition unit 132, for example, includes a radiation unit and a light receiving unit, and may acquire the image on the sheet using the intensity of an electromagnetic wave that is received by the light receiving unit. The radiation unit radiates the electromagnetic wave. The receiving unit receives scattering light or reflection light of the electromagnetic wave that is radiated by the radiation unit.

The image acquisition unit 132, for example, includes a radiation unit that radiates a terahertz wave, and a light receiving unit that receives a terahertz wage, and may read the image on the sheet by causing the terahertz wave to pass through the sheet. The terahertz has a long wavelength, and passes through the sheet. For the image acquisition unit 132 with this configuration, a timing for reflection of the terahertz wave from an overlapping portion of a sheet varies from page to page (this phenomenon is hereinafter referred to as a "time difference."). For this reason, a plurality of pages that are stacked on top of one another are possibly identified.

The transportation roller 16-N (N is an integer that ranges from 1 to 7) transports the sheet. The transportation roller 16-N, for example, includes two rollers, that is, a drive roller and a driven roller. In the transportation roller 16-N, the sheet is interposed between the drive roller and then driven roller. The transportation roller 16-N transports the sheet by rotation of the drive roller and the driven roller. The transportation roller 16-N, if not individually distinguished, is hereinafter referred to as the transportation roller 16.

The path change drive unit 17 is present at a point at which a transportation path branches, and changes the transportation path for the sheet. The path change drive unit 17 changes the transportation path for the sheet in such a manner that a sheet that satisfies a prescribed condition is discharged to a prescribed tray among the paper discharge trays 151-1 to 151-3.

The image forming apparatus 1 according to the first embodiment has six transportation paths along which the sheet is transported. An arrow in FIG. 3 indicates the transportation path for the sheet. The sheet is transported by the transportation roller 16 and the path change drive unit 17 from the accommodation trays 131-1 to 131-3 up to the paper discharge trays 151-1 to 151-3 by way of the image formation unit 121 and the fixing unit 122.

Figure 6:
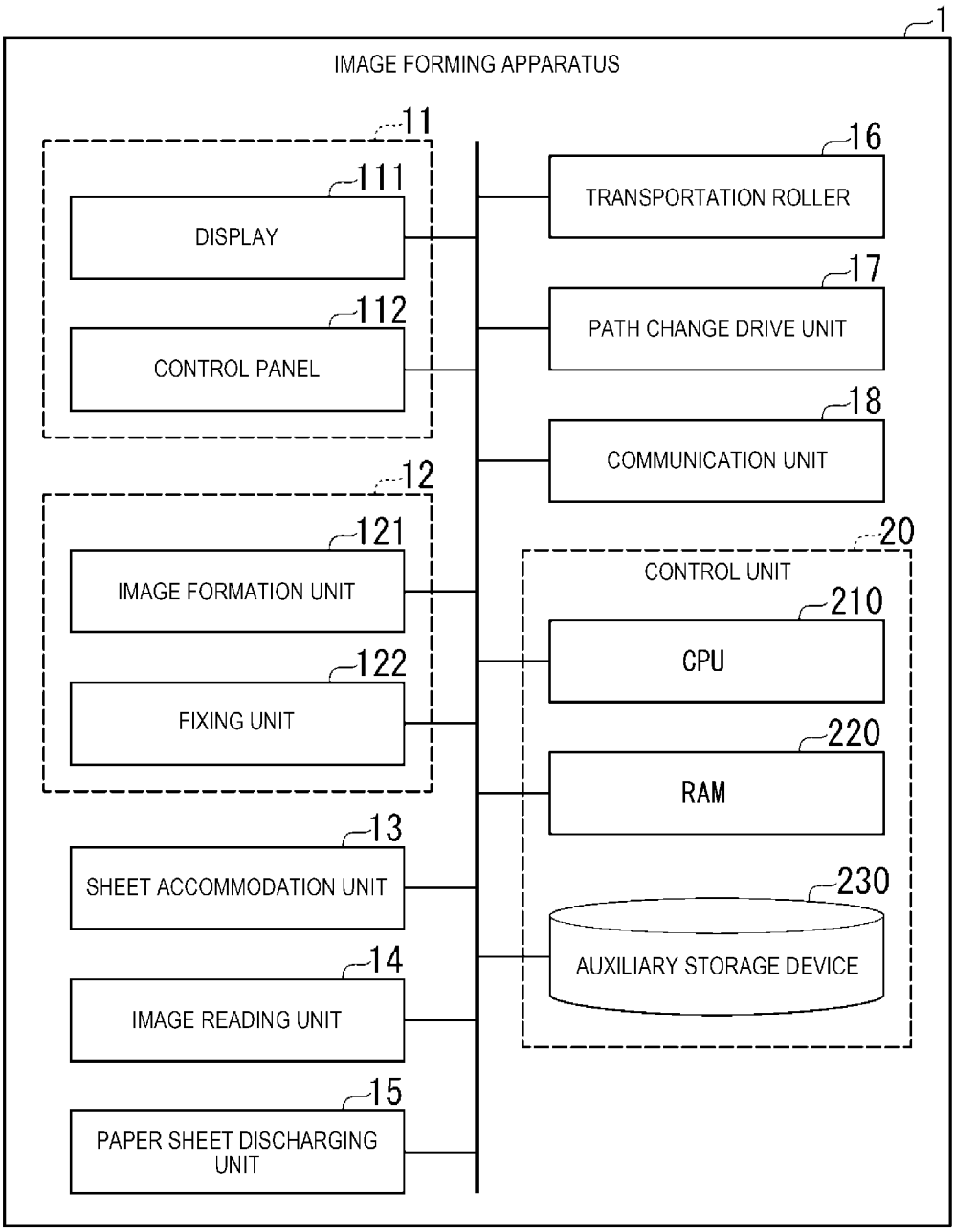
FIG. 6 is a diagram illustrating a specific example of a hardware configuration of the image forming apparatus according to the first embodiment.

FIG. 6 is a diagram illustrating a specific example of a hardware configuration of the image forming apparatus 1 according to the first embodiment. The image forming apparatus 1 includes a central processing unit (CPU) 210, a random access memory (RAM) 220, an auxiliary storage device 230, and the like, which are connected to each other through a bus, and executes a program. With the execution of the program, the image forming apparatus 1 functions as an apparatus that includes the touch panel 11, the printing unit 12, the sheet accommodation unit 13, the image reading unit 14, the paper sheet discharging unit 15, the transportation roller 16, the path change drive unit 17, and a communication unit 18. The CPU 210 reads a program that is stored in the auxiliary storage device 230 for loading on the RAM 220, executes the program, and thus a control unit 20 is generated.

The communication unit 18 is configured to include a communication interface for the image forming apparatus 1 itself to make a connection to an external apparatus. The communication unit 18 communicates with the external apparatus through the communication interface.

The auxiliary storage device 230 is configured with a storage device, such as a magnetic hard disk device or a semiconductor memory device. An operational information is stored in the auxiliary storage device 230. Operational information includes information (hereinafter referred to as "sheet transportation path information") relating to the transportation path for the sheet, and information indicating processing (hereinafter referred to as "printing unit performance processing") that is performed by the printing unit 12. The printing unit performance processing is printing processing, decolorization heating processing, or non-heating processing. The printing processing is processing in which the printing unit 12 prints the image on the sheet. The decolorization heating processing is processing in which the fixing unit 122 decolorizes the image on the sheet. The non-heating processing is processing in which the image formation unit 121 does not form the image and in which the fixing unit 122 does not heat the sheet.

FIG. 7 is a diagram illustrating a specific example of the operational information according to the first embodiment. The operational information, for example, is recorded, as an operational information table D110, in the auxiliary storage device 230. The operational information table D110 has a record for every "determination condition." Each record has a value of each of the "determination condition," the "transportation path," the printing unit processing." The "determination condition" is information that is acquired before the image forming apparatus 1 performs image processing. The "determination condition" in FIG. 7 is represented by three values, that is, values of an "input instruction," "the presence or absence of the image, and a type of toner" for the "transportation condition." The "input instruction" indicates an instruction relating to processing of the image that is input into the image forming apparatus 1 itself. The "presence or absence of an image" indicates the presence or absence of the image on the sheet." The"type of toner" indicates whether the image on the sheet that is a target for the reading by the image acquisition unit 132 is an image that is printed by the decolorable toner or an image that is printed by the non-decolorable toner.

The "input instruction" has a value that represents "printing" or "decolorable." The "printing" indicates that an instruction to print an image is input into the image forming apparatus 1. The "decolorable" indicates that an instruction to decolorize an image is input into the image forming apparatus 1. The "presence or absence of the image" has a value that presents "present" or "absent." The "present" indicates that an image is printed on the sheet that is the target for the reading by the image acquisition unit 132. The "absent" indicates that an image is not printed on the sheet that is the target for the reading by the image acquisition unit 132. The "type of toner" has a value that presents "decolorable," "non-decolorable, or "-." The "decolorable" indicates that the image that is printed on the sheet which is the target for the reading by the image acquisition unit 132 is an image that is printed by the decolorable toner. The "non-decolorable" indicates that the image which is printed on the sheet that is the target for the reading by the image acquisition unit 132 is an image that is printed by the non-decolorable toner. The "-" indicates that an image is not printed on the sheet that is the target for the reading by the image acquisition unit 132.

The "transportation path" indicates the transportation path along which the sheet is transported by the image forming apparatus 1. The "transportation path" has a value that represents each of the "first printing-time transportation path," the "second printing-time transportation path," the "third printing-time transportation path," the "first decolorization-time transportation path," the "second decolorization-time transportation path," and the "third decolorization-time transportation path." The "first printing-time transportation path," the "second printing-time transportation path," the "third printing-time transportation path," the "first decolorization-time transportation path," the "second decolorization-time transportation path," and the "third decolorization-time transportation path" indicate six transportation paths, respectively, in the image forming apparatus 1.

The "printing unit processing" indicates processing that is performed by the printing unit 12. The "printing unit processing" has a value that presents "heating" or "non-heating." The "heating" indicates that, with the heat source unit 1221, the fixing unit 122 heats the sheet to a temperature in accordance with the "input instruction." If the item "input instruction" is "printing," the temperature in accordance with the "input instruction" is a temperature for fixing the toner. If the item "input instruction" is "decolorable" the temperature in accordance with the "input instruction" is a temperature for decolorizing the decolorable toner. The "non-heating" indicates that the fixing unit 122 does not heat the sheet.

It is noted that in the record in which the "input instruction" is "printing" and the "presence or absence of the image" is "present," "non-heating in the "printing unit processing" further indicates the following processing. That is, "non-heating is processing in which the image formation unit 121 is controlled in such a manner that the image formation unit 121 does not consume power that makes image formation possible. The power that makes the image formation possible is power with which the image formation unit 121 possibly generates a toner image.

For example, the record D111 indicates operation of the image forming apparatus 1 when an instruction to decolorize an image is input into the image forming apparatus 1, and an image is printed by the decolorable toner on the sheet that is read by the image acquisition unit 132. In this case, the record D111 indicates that the image forming apparatus 1 transports the sheet along the first decolorization-time transportation path, and that the sheet is heated by the heat source unit 1221.

Figure 8:
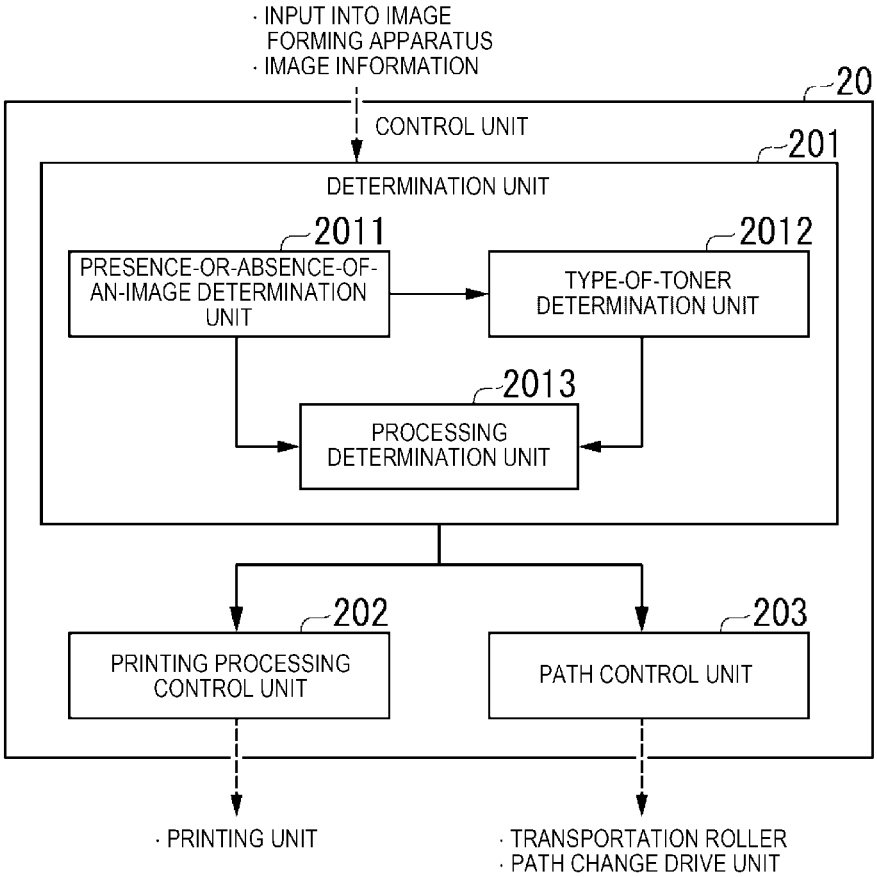
FIG. 8 is a diagram illustrating a specific example of a functional configuration of a control unit in the first embodiment.

FIG. 8 is a diagram illustrating a specific example of a functional configuration of the control unit 20 in the first embodiment. The control unit 20 includes a determination unit 201, a printing processing control unit 202, and a path control unit 203.

Based on the image information on the image on the sheet, which is generated by the image acquisition unit 132, the determination unit 201 selects the printing unit performance processing and the transportation path for the sheet. The determination unit 201 includes a presence-or-absence-of-an-image determination unit 2011, a type-of-toner determination unit 2012, and a processing determination unit 2013.

Based on the image information that is generated by the image acquisition unit 132, the presence-or-absence-of-an-image determination unit 2011 determines whether or not the image is printed on the sheet. If the image that is read by the image acquisition unit 132 satisfies a prescribed condition, the presence-or-absence-of-an-image determination unit 2011 determines that the image is printed on the sheet. The prescribed condition may be any condition as long as the condition is a method that possibly determines the presence or absence of the image on the sheet. The prescribed condition may be a condition that a change rate of a color of the image that is acquired by the image acquisition unit 132 exceeds a prescribed value. The prescribed condition may be a condition that a prescribed ratio of a portion having different colors to a whole surface of the sheet is exceeded. The prescribed condition may be, for example, a condition that a color other than a color of the sheet that is recorded in advance in the image forming apparatus 1 is included in the image that is read by the image acquisition unit 132.

If the image that is read by the image acquisition unit 132 satisfies the prescribed condition, the type-of-toner determination unit 2012 determines that a decolorable toner image is printed on the sheet. Furthermore, if the image that is read by the image acquisition unit 132 satisfies the prescribed condition, the type-of-toner determination unit 2012 determines that non-decolorable toner image is printed on the sheet. The decolorable toner image is an image that is printed by the decolorable toner on the sheet. The non-decolorable toner image is an image that is printed by the non-decolorable toner on the sheet.

A prescribed condition (hereinafter referred to as a "decolorable toner determination condition") that is used by the type-of-toner determination unit 2012 to determine the decolorable toner image may be, for example, a condition that is based on the shininess of the image. Specifically, the decolorable toner determination condition may be a condition that the shininess which is registered in advance with the image forming apparatus 1 is indicated by the sheet. Furthermore, the decolorable toner determination condition, for example, may be a condition that a color which is registered in advance as a color of the decolorable toner with the image forming apparatus 1 is present on the image on the sheet that is acquired by the image acquisition unit 132.

A prescribed condition (hereinafter referred to as a "non-decolorable toner determination condition") that is used by the type-of-toner determination unit 2012 to determine the non-decolorable toner image, for example, may be a condition that is based on the shininess of the image. Specifically, the non-decolorable toner determination condition may be a condition that the shininess that is registered in advance with the image forming apparatus 1 is indicated by the sheet. Furthermore, the non-decolorable toner determination condition, for example, may be a condition that a color which is registered in advance as a color of the non-decolorable toner with the image forming apparatus 1 is present on the image on the sheet that is acquired by the image acquisition unit 132.

Based on a result of the determination by the presence-or-absence-of-an-image determination unit 2011 or the type-of-toner determination unit 2012, the processing determination unit 2013 determines the transportation path for the sheet and the printing unit performance processing.

The presence-or-absence-of-an-image determination unit 2011 may be any functional unit as long as the functional unit has a function of determining the presence or absence of the image on the image using the method that possibly determines whether or not the image is printed on the sheet. For example, if information indicating a color other than the color of the sheet is included in the image information, the presence-or-absence-of-an-image determination unit 2011 may determine that the image is printed.

The printing processing control unit 202 controls the image formation unit 121 and the fixing unit 122 in such a manner that the printing unit performance processing which is selected by the determination unit 201 is performed.

The path control unit 203 controls the transportation roller 16 and the path change drive unit 17 in such a manner that the sheet is transported along the transportation path that is selected by the determination unit 201.

Figure 9:
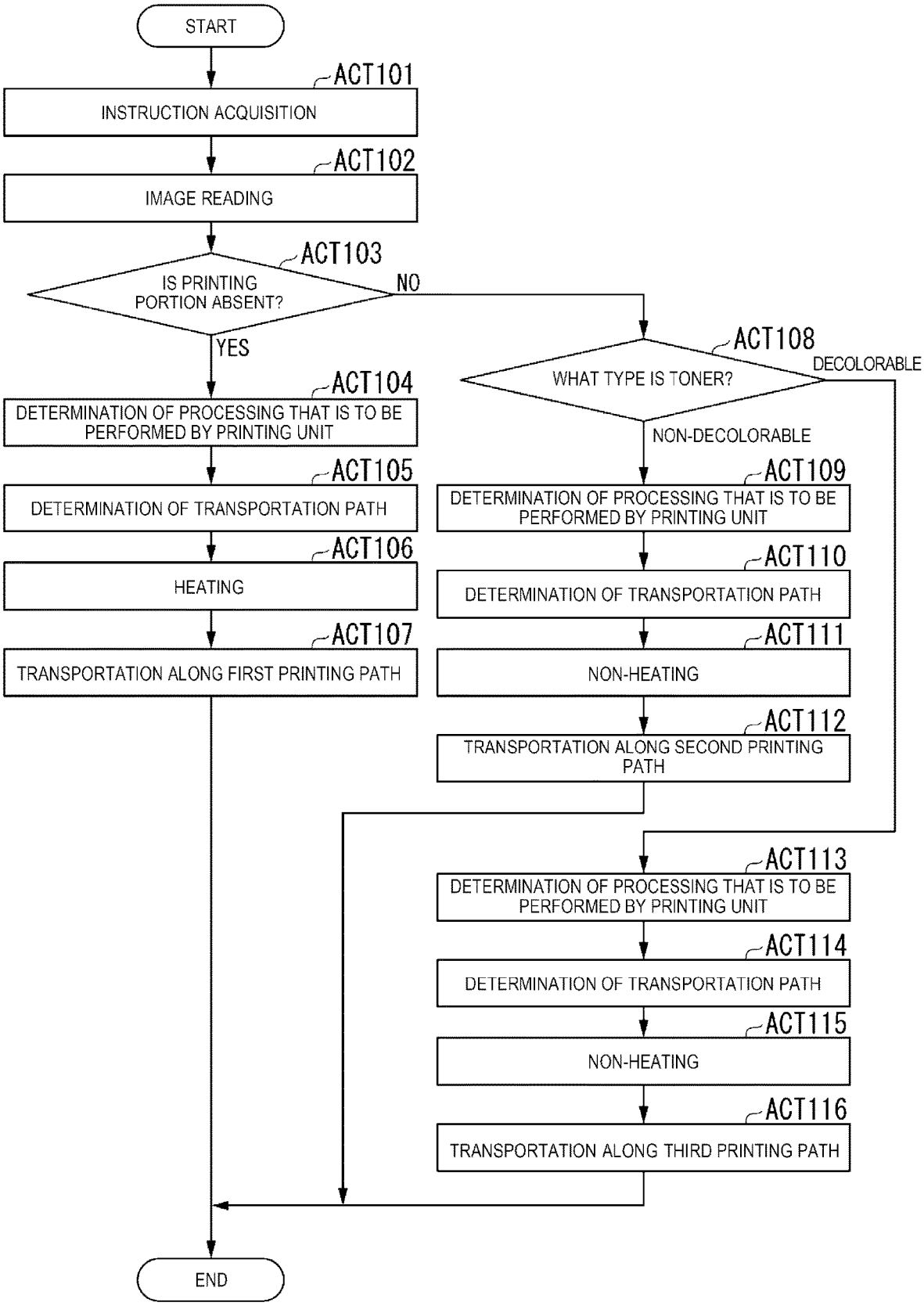
FIG. 9 is a flowchart illustrating a flowchart illustrating a flow for specific processing that is to be performed if an instruction to print an image is input into the image forming apparatus according to the first embodiment.

FIG. 9 is a flowchart illustrating a flow for specific processing that is to be performed if the instruction to print the image is input into the image forming apparatus 1 according to the first embodiment.

The image forming apparatus 1 acquires an instruction (hereinafter referred to as an "image printing instruction") to print the image (ACT 101). Based on the image printing instruction, the image acquisition unit 132 reads an image on a sheet in a prescribed accommodation tray 131 (ACT 102). Specifically, the image acquisition unit 132 reads the image on the sheet that is accommodated in the accommodation tray 131-1. Subsequent to ACT 102, based on the image on the sheet that is read by the image acquisition unit 132 in ACT 102, the presence-or-absence-of-an-image determination unit 2011 determines whether or not the image is printed on the sheet (ACT 103). If the image is not printed on the image (YES in ACT 103), the processing determination unit 2013 determines processing that is to be performed by the printing unit 12, referring to the operational information (ACT 104). Specifically, the processing determination unit 2013 determines the processing that is to be performed by the printing unit 12, by performing the following processing. Referring to the operational information table D111, the processing determination unit 2013 selects a record of which the item "input instruction" has a value of "printing" and of which the item "presence or absence of the image has a value of "absent." The processing determination unit 2013 acquires a value that the item "printing unit processing" has, from the selected record. The processing determination unit 2013 determines the processing that is indicated by the acquired value, as the processing that is to be performed by the printing processing control unit 202. Subsequent to ACT 104, the processing determination unit 2013 determines the transportation path for the sheet referring to the operational information (ACT 105). Specifically, the processing determination unit 2013 determines the transportation path along which the image forming apparatus 1 transports the sheet, by performing the following processing. The processing determination unit 2013 selects the record that is selected in ACT 105, referring to the operational information table D111. The processing determination unit 2013 acquires a value that the item "transportation path" has, from the selected record. The processing determination unit 2013 determines the transportation path that is indicated by the acquired value, as the transportation path along which the sheet is to be transported. Subsequent to ACT 105, the printing processing control unit 202 performs the processing that is determined by the processing determination unit 2013 in ACT 104 (ACT 106). Specifically, the printing processing control unit 202 performs processing that controls the heat source unit 1221, in such a manner that the heat source unit 1221 heats the sheet to the fixing temperature. Additionally, the printing processing control unit 202 performs processing that controls the image formation unit 121, in such a manner that the image formation unit 121 performs the formation of the image. The path control unit 203 transports the sheet along the first printing-time transportation path that is the transportation path which is determined in ACT 105 (ACT 107).

Figure 10:
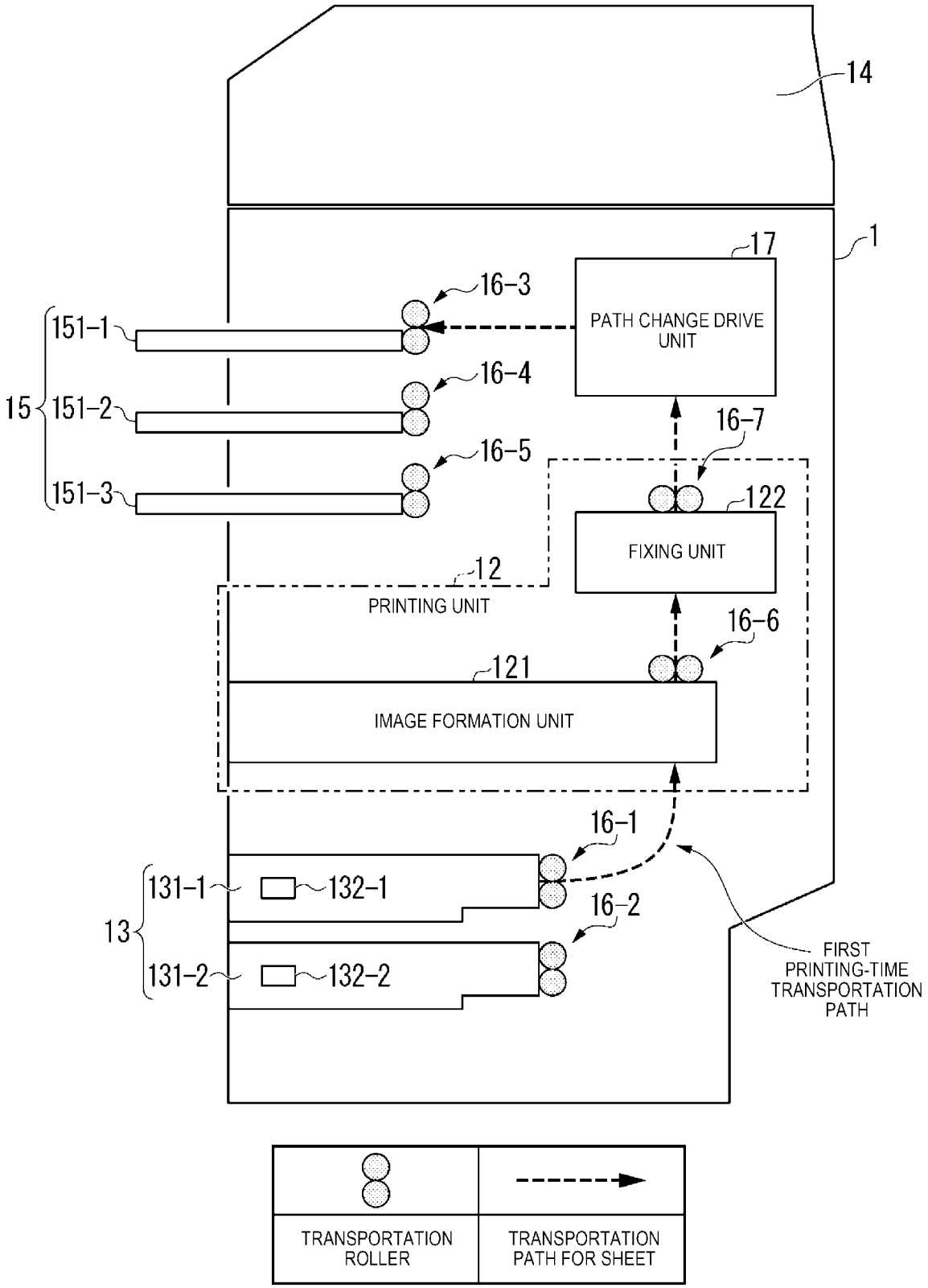
FIG. 10 is a diagram illustrating a specific example of a first printing-time transportation path in the first embodiment.

FIG. 10 is a diagram illustrating a specific example of the first printing-time transportation path in the first embodiment.

Along the first printing-time transportation path, the sheet that is accommodated in the accommodation tray 131-1 is transported by a transportation roller 16-1 to the image formation unit 121. The sheet that is transported to the image formation unit 121 is transported by a transportation roller 16-6 to the fixing unit 122. The sheet that is transported to the fixing unit 122 is transported by a transportation roller 16-7 to the path change drive unit 17. The sheet that is transported to the path change drive unit 17 is discharged by a transportation roller 16-3 to the paper discharge tray 151-1.

A description is provided with reference again to FIG. 9. On the other hand, if a printing place is present in ACT 103 (NO in ACT 103), the type-of-toner determination unit 2012 determines whether the toner that is used for the printing of the image on the sheet is the decolorable toner or the non-decolorable toner (ACT 108). If the type of toner is the non-decolorable toner (non-decolorable in ACT 108), the processing determination unit 2013 determines the processing that is to be performed by the printing unit 12, referring to the operational information (ACT 109). Specifically, the processing determination unit 2013 determines the processing that is to be performed by the printing unit 12, by performing the following processing. Referring to the operational information table D111, the processing determination unit 2013 selects a record of which the item "input instruction" has a value of "printing," of which the item "presence or absence of the image" has a value of "presence," and of which the item "type of toner" has a value of "non-decolorable." The processing determination unit 2013 acquires a value that the item "printing unit processing" has, from the selected record. The processing determination unit 2013 determines the processing that is indicated by the acquired value, as the processing that is to be performed by the printing processing control unit 202. Subsequent to ACT 109, the processing determination unit 2013 determines the transportation path for the sheet referring to the operational information (ACT 110). Specifically, the processing determination unit 2013 determines the transportation path along which the image forming apparatus 1 transports the sheet, by performing the following processing. The processing determination unit 2013 selects the record that is selected in ACT 109, referring to the operational information table D111. The processing determination unit 2013 acquires a value that the item "transportation path" has, from the selected record. The processing determination unit 2013 determines the transportation path that is indicated by the acquired value, as the transportation path along which the sheet is to be transported. Subsequent to ACT 110, the printing processing control unit 202 performs the processing that is determined by the processing determination unit 2013 in ACT 109 (ACT 111). Specifically, the printing processing control unit 202 performs control that does not supply power for the heating of the sheet to the fixing unit 122. Additionally, the printing processing control unit 202 performs processing that causes the image formation unit 121 not to consume the power which makes the formation of the image possible. The path control unit 203 transports the sheet along a second printing-time transportation path that is the transportation path which is determined in ACT 109 (ACT 112).

Figure 11:
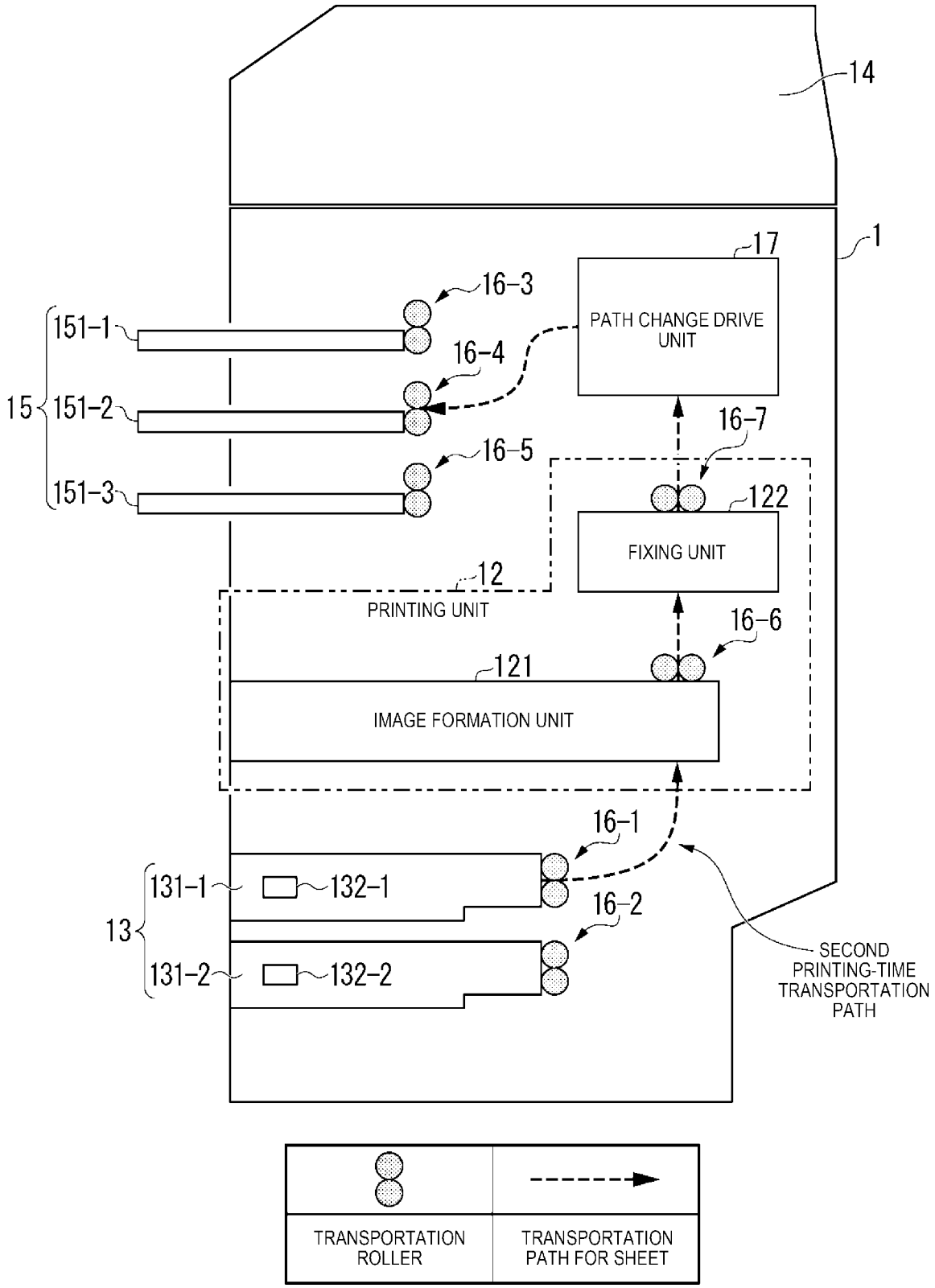
FIG. 11 is a diagram illustrating a specific example of a second printing-time transportation path in the first embodiment.

FIG. 11 is a diagram illustrating a specific example of the second printing-time transportation path in the first embodiment.

Along the second printing-time transportation path, the sheet that is accommodated in the accommodation tray 131-1 is transported by the transportation roller 16-1 to the image formation unit 121. The sheet that is transported to the image formation unit 121 is transported by the transportation roller 16-6 to the fixing unit 122. The sheet that is transported to the fixing unit 122 is transported by the transportation roller 16-7 to the path change drive unit 17. The sheet that is transported to the path change drive unit 17 is discharged by a transportation roller 16-4 to a paper discharge tray 151-2.

A description is provided with reference again to FIG. 9. On the other hand, in ACT 108, if the type of toner is the decolorable toner (decolorable in ACT 108), the processing determination unit 2013 determines the processing that is to be performed by the printing unit 12, referring to the operational information (ACT 113). Specifically, the processing determination unit 2013 determines the processing that is to be performed by the printing unit 12, by performing the following processing. Referring to the operational information table D111, the processing determination unit 2013 selects a record of which the item "input instruction" has a value of "printing," of which the item "presence or absence of the image has a value of "presence," and of which the item "type of toner" has a value of "decolorable." The processing determination unit 2013 acquires a value that the item "printing unit processing" has, from the selected record. The processing determination unit 2013 determines the processing that is indicated by the acquired value, as the processing that is to be performed by the printing processing control unit 202. Subsequent to ACT 113, the processing determination unit 2013 determines the transportation path for the sheet referring to the operational information (ACT 114). Specifically, the processing determination unit 2013 determines the transportation path along which the image forming apparatus 1 transports the sheet, by performing the following processing. The processing determination unit 2013 selects the record that is selected in ACT 113, referring to the operational information table D111. The processing determination unit 2013 acquires a value that the item "transportation path" has, from the selected record. The processing determination unit 2013 determines the transportation path that is indicated by the acquired value, as the transportation path along which the sheet is to be transported. Subsequent to ACT 114, the printing processing control unit 202 performs the processing that is determined by the processing determination unit 2013 in ACT 109 (ACT 115). Specifically, the printing processing control unit 202 performs the control that does not supply the power for the heating of the sheet to the fixing unit 122. Additionally, the printing processing control unit 202 performs processing that causes the image formation unit 121 not to consume the power which makes the formation of the image possible. The path control unit 203 transports the sheet along a third printing-time transportation path that is the transportation path which is determined in ACT 114 (ACT 116).

Figure 12:
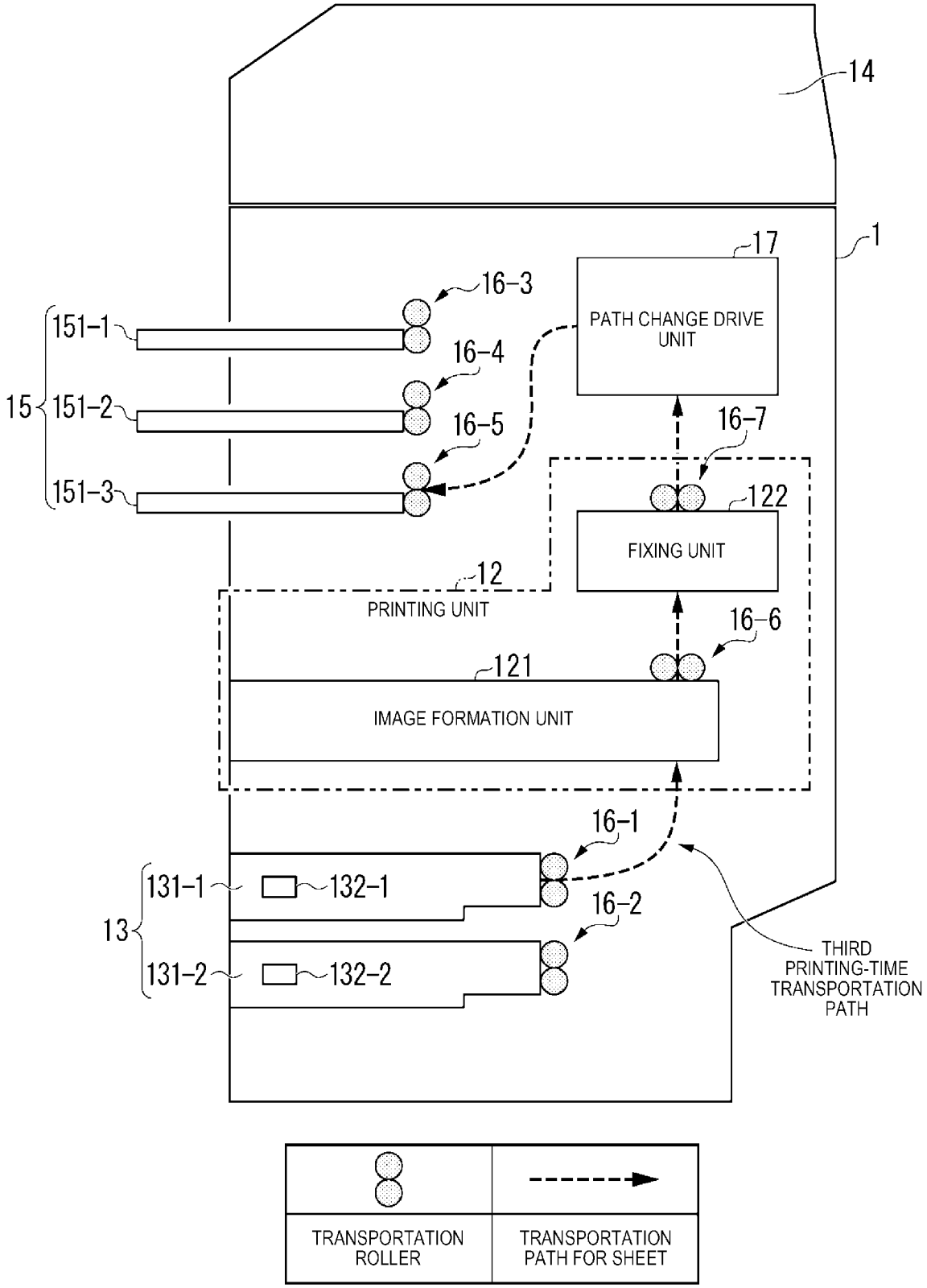
FIG. 12 is a diagram illustrating a specific example of a third printing-time transportation path in the first embodiment.

FIG. 12 is a diagram illustrating a specific example of the third printing-time transportation path in the first embodiment.

Along the third printing-time transportation path, the sheet that is accommodated in the accommodation tray 131-1 is transported by the transportation roller 16-1 to the image formation unit 121. The sheet that is transported to the image formation unit 121 is transported by the transportation roller 16-6 to the fixing unit 122. The sheet that is transported to the fixing unit 122 is transported by the transportation roller 16-7 up to the path change drive unit 17. The sheet that is transported to the path change drive unit 17 is discharged by a transportation roller 16-5 to the paper discharge tray 151-3.

Figure 13:
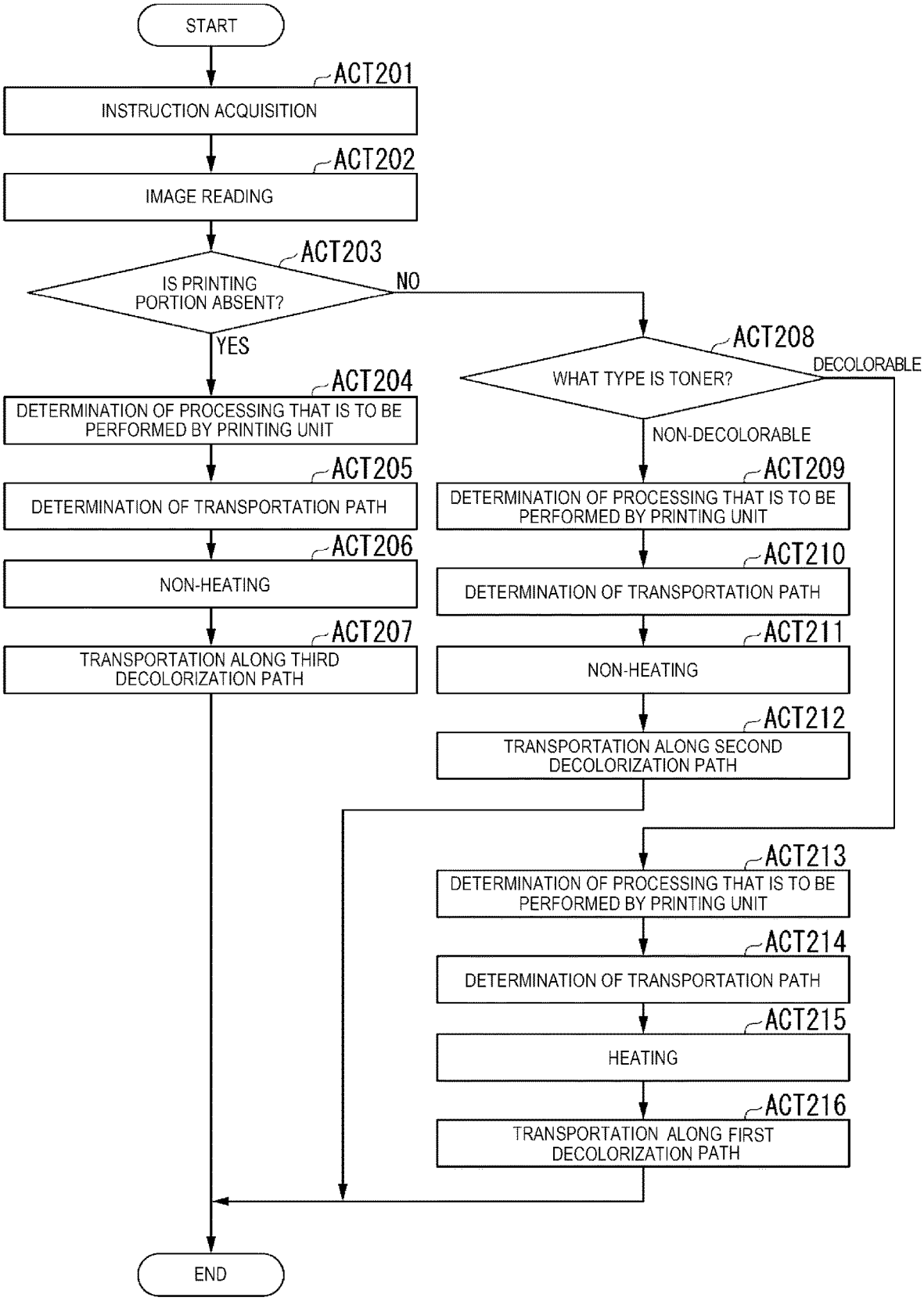
FIG. 13 is a flowchart illustrating a flow for specific processing that is to be performed if an instruction to decolorize the image is input into the image forming apparatus according to the first embodiment.

FIG. 13 is a flowchart illustrating a flow for specific processing that is to be performed if the instruction to decolorize the image is input into the image forming apparatus 1 according to the first embodiment.

The image forming apparatus 1 acquires an instruction (hereinafter referred to as an "image decolorization instruction") to decolorize the image (ACT 201). Based on the image printing instruction, the image acquisition unit 132 reads an image on a sheet in a prescribed accommodation tray 131 (ACT 202). Specifically, the image acquisition unit 132 reads the image on the sheet that is accommodated in the accommodation tray 131-2. Subsequent to ACT 202, based on the image on the sheet that is read by the image acquisition unit 132 in ACT 202, the presence-or-absence-of-an-image determination unit 2011 determines whether or not the image is printed on the sheet (ACT 203). If the image is not printed on the image (YES in ACT 203), the processing determination unit 2013 determines the processing that is to be performed by the printing unit 12, referring to the operational information (ACT 204). Specifically, the processing determination unit 2013 determines the processing that is to be performed by the printing unit 12, by performing the following processing. Referring to the operational information table D111, the processing determination unit 2013 selects a record of which the item "input instruction" has a value of "decolorable" and of which the item "presence or absence of the image has a value of "absence." The processing determination unit 2013 acquires a value that the item "printing unit processing" has, from the selected record. The processing determination unit 2013 determines the processing that is indicated by the acquired value, as the processing that is to be performed by the printing processing control unit 202. Subsequent to ACT 204, the processing determination unit 2013 determines the transportation path for the sheet referring to the operational information (ACT 205). Specifically, the processing determination unit 2013 determines the transportation path along which the image forming apparatus 1 transports the sheet, by performing the following processing. The processing determination unit 2013 selects the record that is selected in ACT 205, referring to the operational information table D111. The processing determination unit 2013 acquires a value that the item "transportation path" has, from the selected record. The processing determination unit 2013 determines the transportation path that is indicated by the acquired value, as the transportation path along which the sheet is to be transported. Subsequent to ACT 205, the printing processing control unit 202 performs the processing that is determined by the processing determination unit 2013 in ACT 204 (ACT 206). Specifically, the printing processing control unit 202 performs control that does not supply power for heating the sheet up to the decolorization temperature, to the fixing unit 122. The path control unit 203 transports the sheet along the third decolorization-time transportation path that is the transportation path which is determined in ACT 205 (ACT 207).

Figure 14:
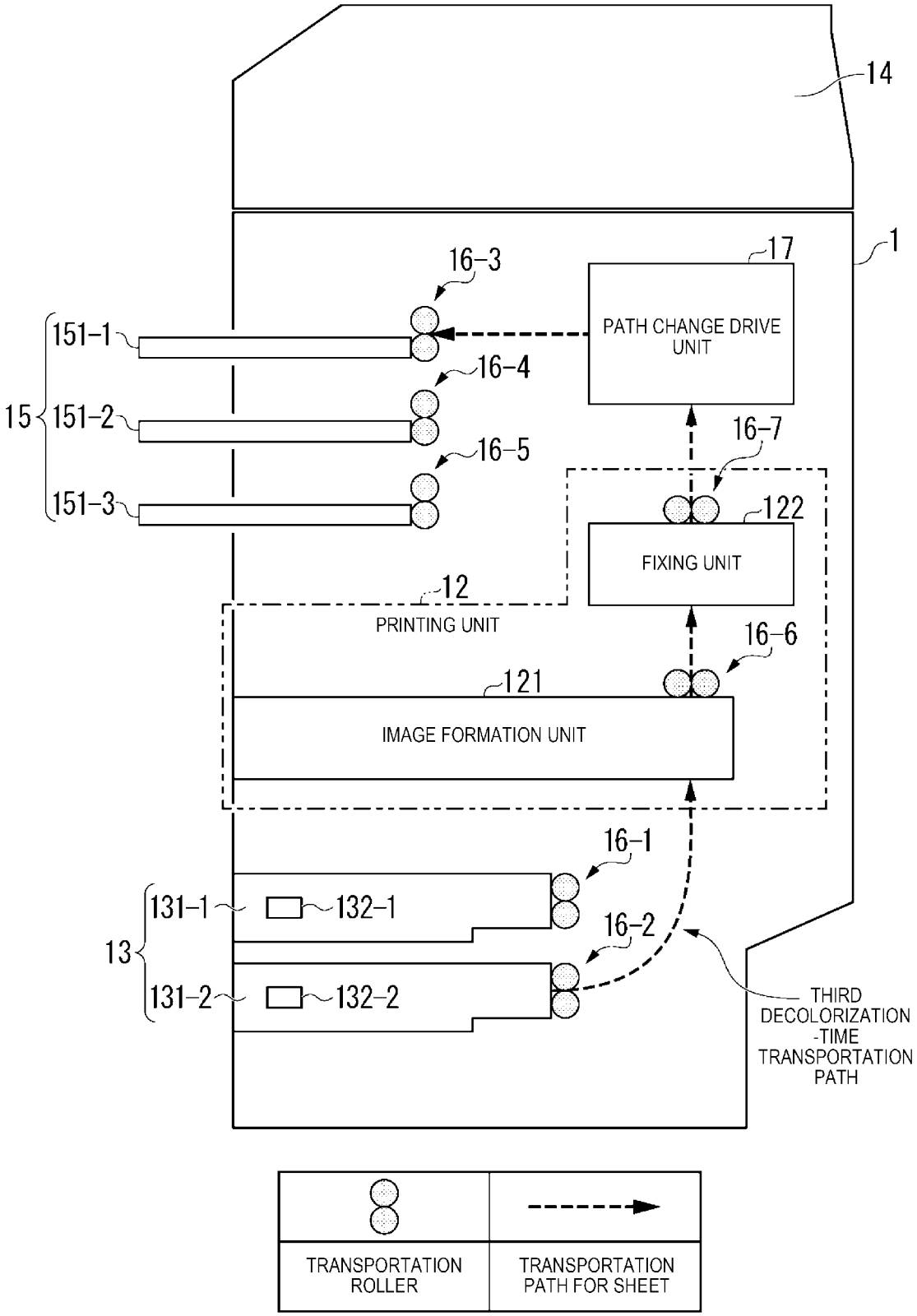
FIG. 14 is a diagram illustrating a specific example of a third decolorization-time transportation path in the first embodiment.

FIG. 14 is a diagram illustrating a specific example of the third decolorization-time transportation path in the first embodiment.

Along the first decolorization-time transportation path, the sheet that is accommodated in the accommodation tray 131-2 is transported by the transportation roller 16-2 to the image formation unit 121. The sheet that is transported to the image formation unit 121 is transported by the transportation roller 16-6 to the fixing unit 122. The sheet that is transported to the fixing unit 122 is transported by the transportation roller 16-7 up to the path change drive unit 17. The sheet that is transported to the path change drive unit 17 is discharged by a transportation roller 16-3 to the paper discharge tray 151-1.

A description is provided with reference again to FIG. 13. On the other hand, if a printing place is present in ACT 203 (NO in ACT 203), the type-of-toner determination unit 2012 determines whether the toner that is used for the printing of the image on the sheet is the decolorable toner or the non-decolorable toner (ACT 208). If the type of toner is the non-decolorable toner (non-decolorable in ACT 208), the processing determination unit 2013 determines the processing that is to be performed by the printing unit 12, referring to the operational information (ACT 209). Specifically, the processing determination unit 2013 determines the processing that is to be performed by the printing unit 12, by performing the following processing. Referring to the operational information table D111, the processing determination unit 2013 selects a record of which the item "input instruction" has a value of "decolorable," of which the item "presence or absence of the image has a value of "presence," and of which the item "type of toner" has a value of "non-decolorable." The processing determination unit 2013 acquires a value that the item "printing unit processing" has, from the selected record. The processing determination unit 2013 determines the processing that is indicated by the acquired value, as the processing that is to be performed by the printing processing control unit 202. Subsequent to ACT 209, the processing determination unit 2013 determines the transportation path for the sheet referring to the operational information (ACT 210). Specifically, the processing determination unit 2013 determines the transportation path along which the image forming apparatus 1 transports the sheet, by performing the following processing. The processing determination unit 2013 selects the record that is selected in ACT 209, referring to the operational information table D111. The processing determination unit 2013 acquires a value that the item "transportation path" has, from the selected record. The processing determination unit 2013 determines the transportation path that is indicated by the acquired value, as the transportation path along which the sheet is to be transported. Subsequent to ACT 210, the printing processing control unit 202 performs the processing that is determined by the processing determination unit 2013 in ACT 209 (ACT 211). Specifically, the printing processing control unit 202 performs the control that does not supply the power for the heating of the sheet to the fixing unit 122. The path control unit 203 transports the sheet along the second decolorization-time transportation path that is the transportation path which is determined in ACT 209 (ACT 212).

Figure 15:
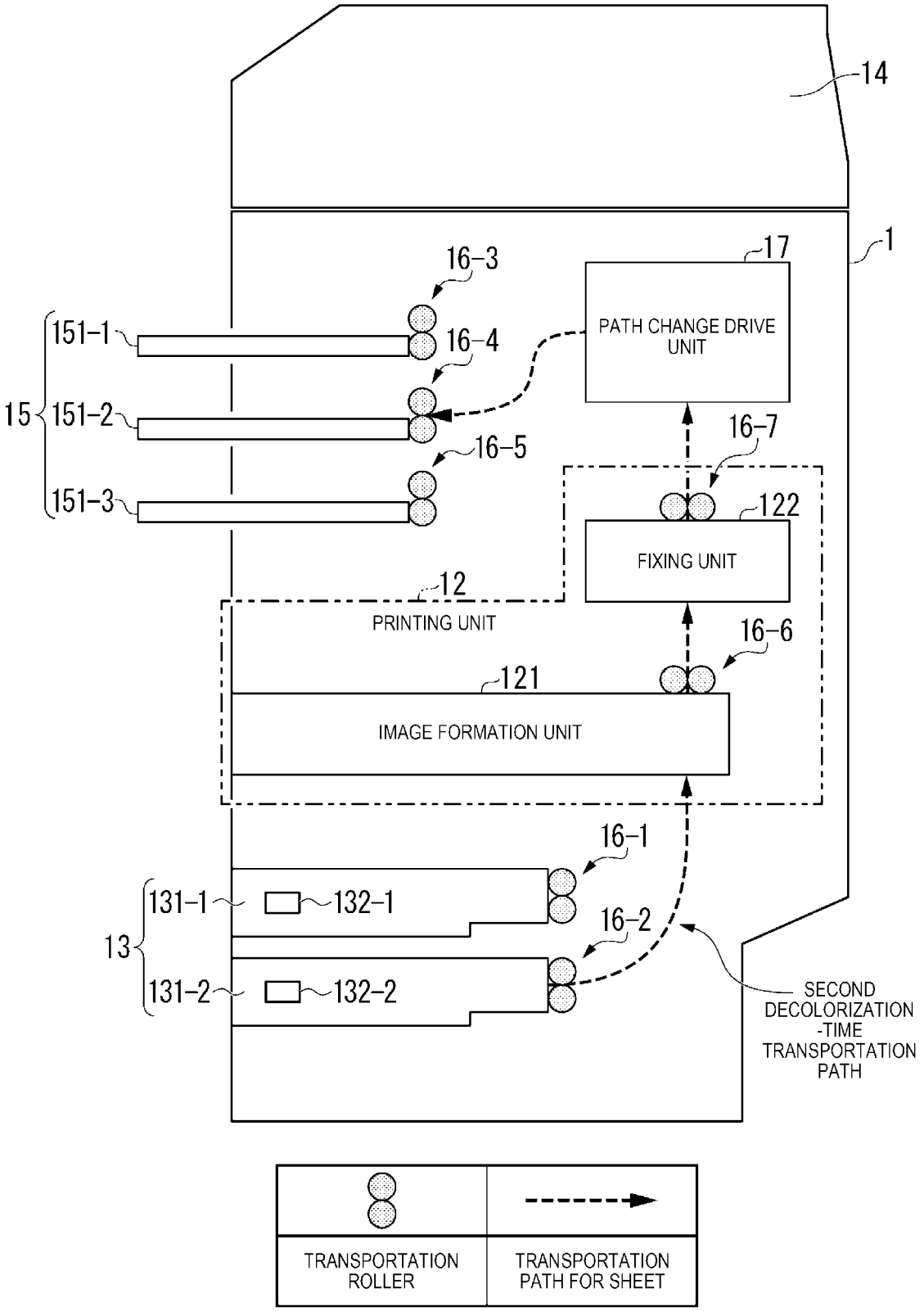
FIG. 15 is a diagram illustrating a specific example of a second decolorization-time transportation path in the first embodiment.

FIG. 15 is a diagram illustrating a specific example of the second decolorization-time transportation path in the first embodiment.

Along the second decolorization-time transportation path, the sheet that is accommodated in the accommodation tray 131-2 is transported by the transportation roller 16-2 to the image formation unit 121. The sheet that is transported to the image formation unit 121 is transported by the transportation roller 16-6 to the fixing unit 122. The sheet that is transported to the fixing unit 122 is transported by the transportation roller 16-7 up to the path change drive unit 17. The sheet that is transported to the path change drive unit 17 is discharged by a transportation roller 16-4 to a paper discharge tray 151-2.

A description is provided with reference again to FIG. 13. On the other hand, in ACT 208, if the type of toner is the decolorable toner (decolorable in ACT 208), the processing determination unit 2013 determines the processing that is to be performed on the printing unit 12, referring to the operational information (ACT 213). Specifically, the processing determination unit 2013 determines the processing that is to be performed by the printing unit 12, by performing the following processing. Referring to the operational information table D111, the processing determination unit 2013 selects a record of which the item "input instruction" has a value of "decolorable," of which the item "presence or absence of the image has a value of "presence," and of which the item "type of toner" has a value of "decolorable." The processing determination unit 2013 acquires a value that the item "printing unit processing" has, from the selected record. The processing determination unit 2013 determines the processing that is indicated by the acquired value, as the processing that is to be performed by the printing processing control unit 202. Subsequent to ACT 213, the processing determination unit 2013 determines the transportation path for the sheet referring to the operational information (ACT 214). Specifically, the processing determination unit 2013 determines the transportation path along which the image forming apparatus 1 transports the sheet, by performing the following processing. The processing determination unit 2013 selects the record that is selected in ACT 213, referring to the operational information table D111. The processing determination unit 2013 acquires a value that the item "transportation path" has, from the selected record. The processing determination unit 2013 determines the transportation path that is indicated by the acquired value, as the transportation path along which the sheet is to be transported. Subsequent to ACT 214, the printing processing control unit 202 performs the processing that is determined by the processing determination unit 2013 in ACT 209 (ACT 215). Specifically, the printing processing control unit 202 performs processing in which the heat source unit 1221 heats the sheet to the decolorization temperature. The path control unit 203 transports the sheet along the first decolorization-time transportation path that is the transportation path which is determined in ACT 214 (ACT 216).

Figure 16:
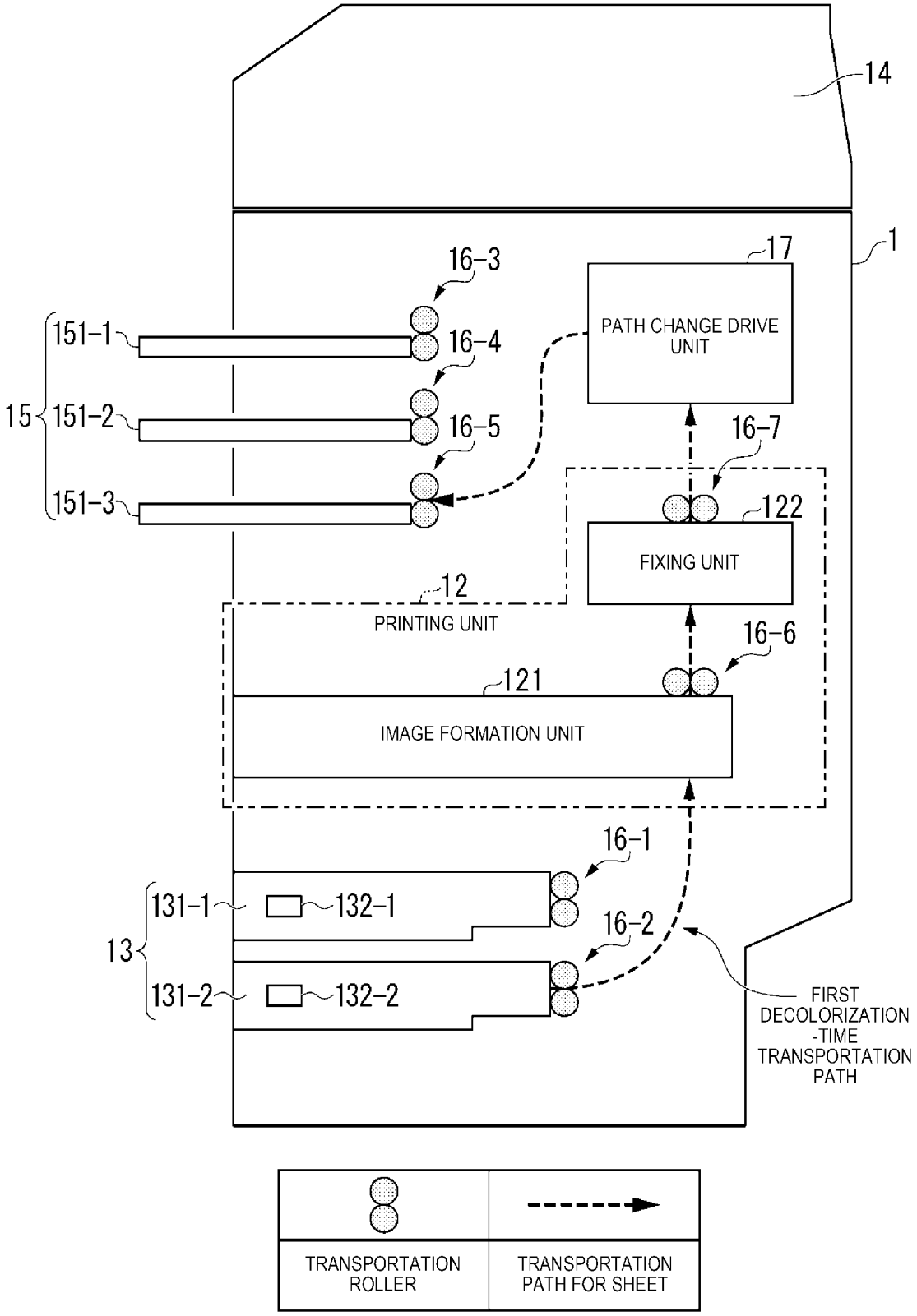
FIG. 16 is a diagram illustrating a specific example of a first decolorization-time transportation path in the first embodiment.

FIG. 16 is a diagram illustrating a specific example of the first decolorization-time transportation path in the first embodiment.

Along the third decolorization-time transportation path, the sheet that is accommodated in the accommodation tray 131-2 is transported by the transportation roller 16-2 to the image formation unit 121. The sheet that is transported to the image formation unit 121 is transported by the transportation roller 16-6 to the fixing unit 122. The sheet that is transported to the fixing unit 122 is transported by the transportation roller 16-7 up to the path change drive unit 17. The sheet that is transported to the path change drive unit 17 is discharged by a transportation roller 16-5 to the paper discharge tray 151-3.

Based on the presence or absence of the image on the sheet, the image forming apparatus 1 in the first embodiment, which is configured in this manner, controls the supply of the power for the heating to the heat source unit 1221. For this reason, energy consumption that accompanies the printing or the decolorizing of the image can be suppressed.

It is noted that the image forming apparatus 1 according to the first embodiment does not necessarily need to transport the sheet when the image is printed on the sheet (which is referred to as a "first error case"), if the instruction to print the image is input into the image forming apparatus 1 itself. In the first error case, the image forming apparatus 1 according to the first embodiment may notify an error without transporting the sheet.

Figure 17:
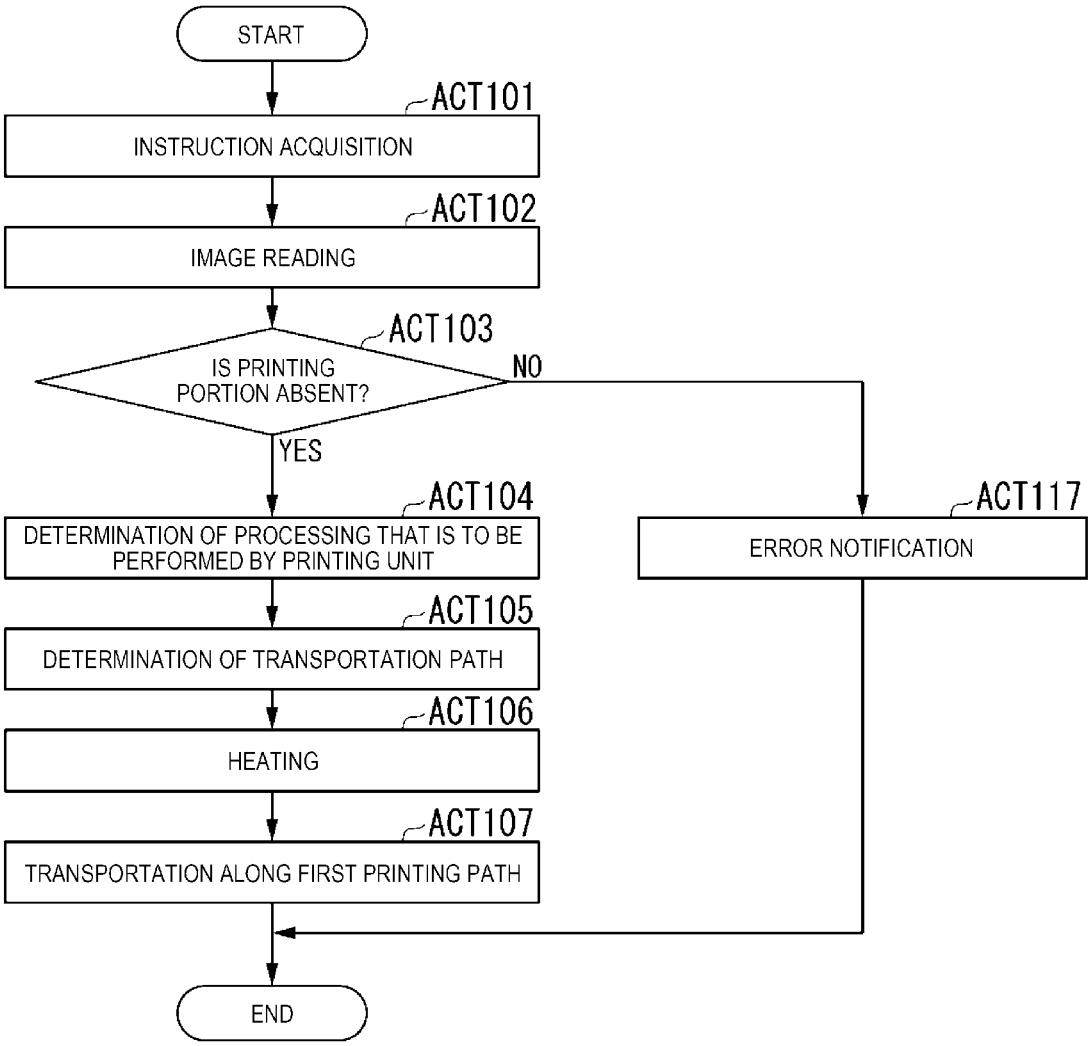
FIG. 17 is a flowchart illustrating a flow for specific processing by the image forming apparatus in a first error case according to the first embodiment.

FIG. 17 is a flowchart illustrating a flow for specific processing by the image forming apparatus 1 in the first error case according to the first embodiment. In FIG. 17, the same processing as in FIG. 9 is given the same reference numeral, and thus a description thereof is omitted.

The flow for the processing that is illustrated in FIG. 17 is different from the flow for the processing that is illustrated in FIG. 9 in that instead of ACT 108 and subsequent acts, processing in ACT 117 is included. The processing in ACT 117 is processing that notifies an error. That is, in ACT 103, if a printing place is present in ACT 103 (NO in ACT 103), the image forming apparatus 1 notifies the error. A method of notifying the error may be any method. The method of notifying the error, for example, may be a method of displaying a screen on which the error is displayed on the touch panel 11.

Furthermore, the image forming apparatus 1 according to the first embodiment does not necessarily need to transport the sheet when the image is not printed on the sheet (which is referred to as a "second error case"), if the instruction to decolorize the image is input into the image forming apparatus 1 itself. In the second error case, the image forming apparatus 1 according to the first embodiment may notify an error without transporting the sheet.

Furthermore, the image forming apparatus 1 according to the first embodiment does not necessarily need to transport the sheet when the image is printed by the non-decolorable toner on the sheet (which is referred to as a "third error case"), if the instruction to decolorize the image is input into the image forming apparatus 1 itself. In the third error case, the image forming apparatus 1 according to the first embodiment may notify the error without transporting the sheet.

Second Embodiment

Figure 18:
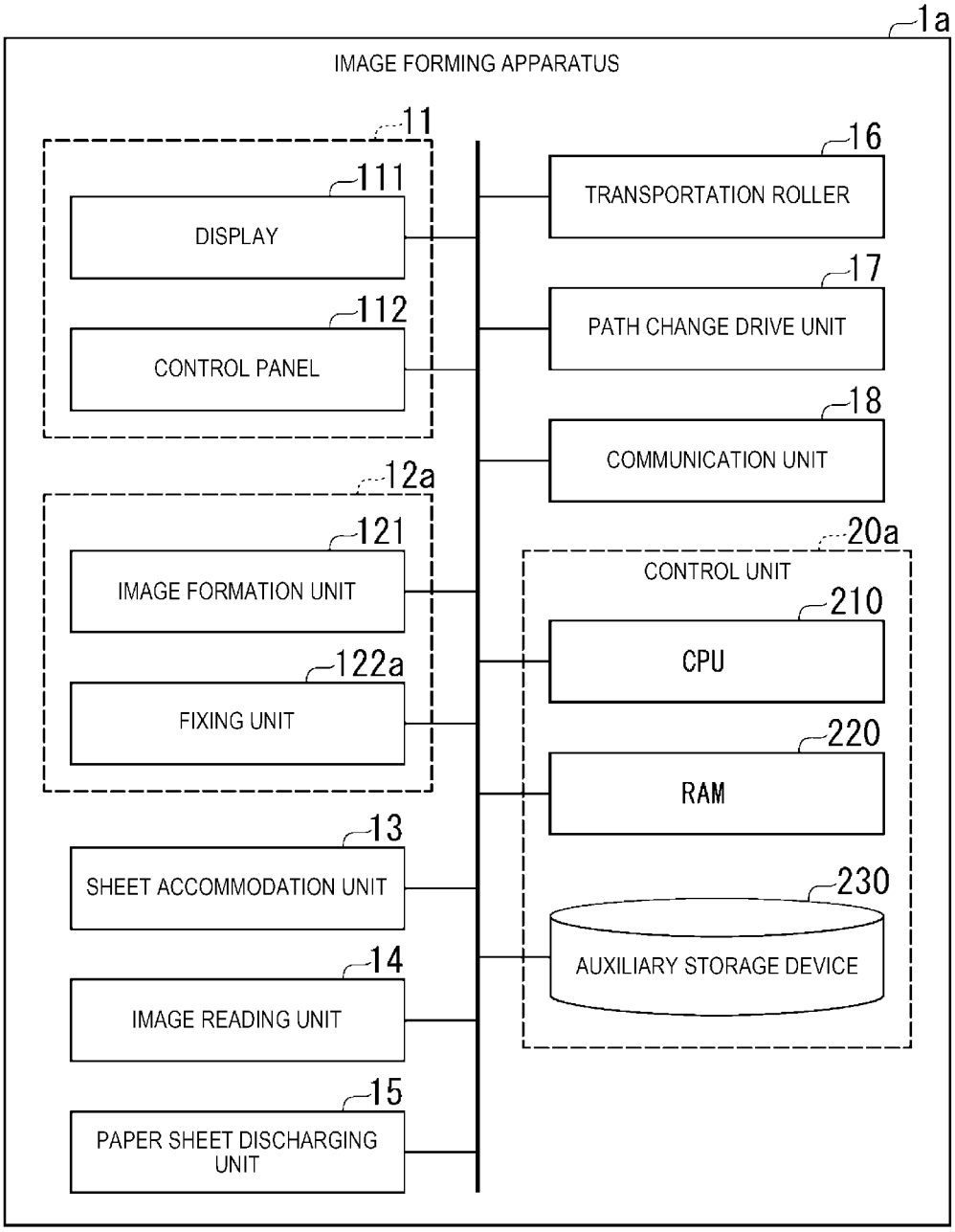
FIG. 18 is a diagram illustrating a specific example of a hardware configuration of an image forming apparatus according to a second embodiment.

FIG. 18 is a diagram illustrating a specific example of a hardware configuration of an image forming apparatus 1*a* according to a second embodiment. An image forming apparatus 1*a* according to the second embodiment is different from the image forming apparatus 1 according to the first embodiment in that a printing unit 12*a* is included instead of the printing unit 12 and in that a control unit 20*a* is included instead of the control unit 20. The printing unit 12*a* is different from the printing unit 12 according to the first embodiment in that a fixing unit 122*a* is included instead of the fixing unit 122. The units which have same functions as the units in the image forming apparatus 1 are hereinafter given the same sign as in FIGS. 3, 5, 6, and 8, and descriptions thereof are omitted.

The fixing unit 122*a* is different from the fixing unit 122 in that a plurality of heat source units 1221 are included.

Figure 19:
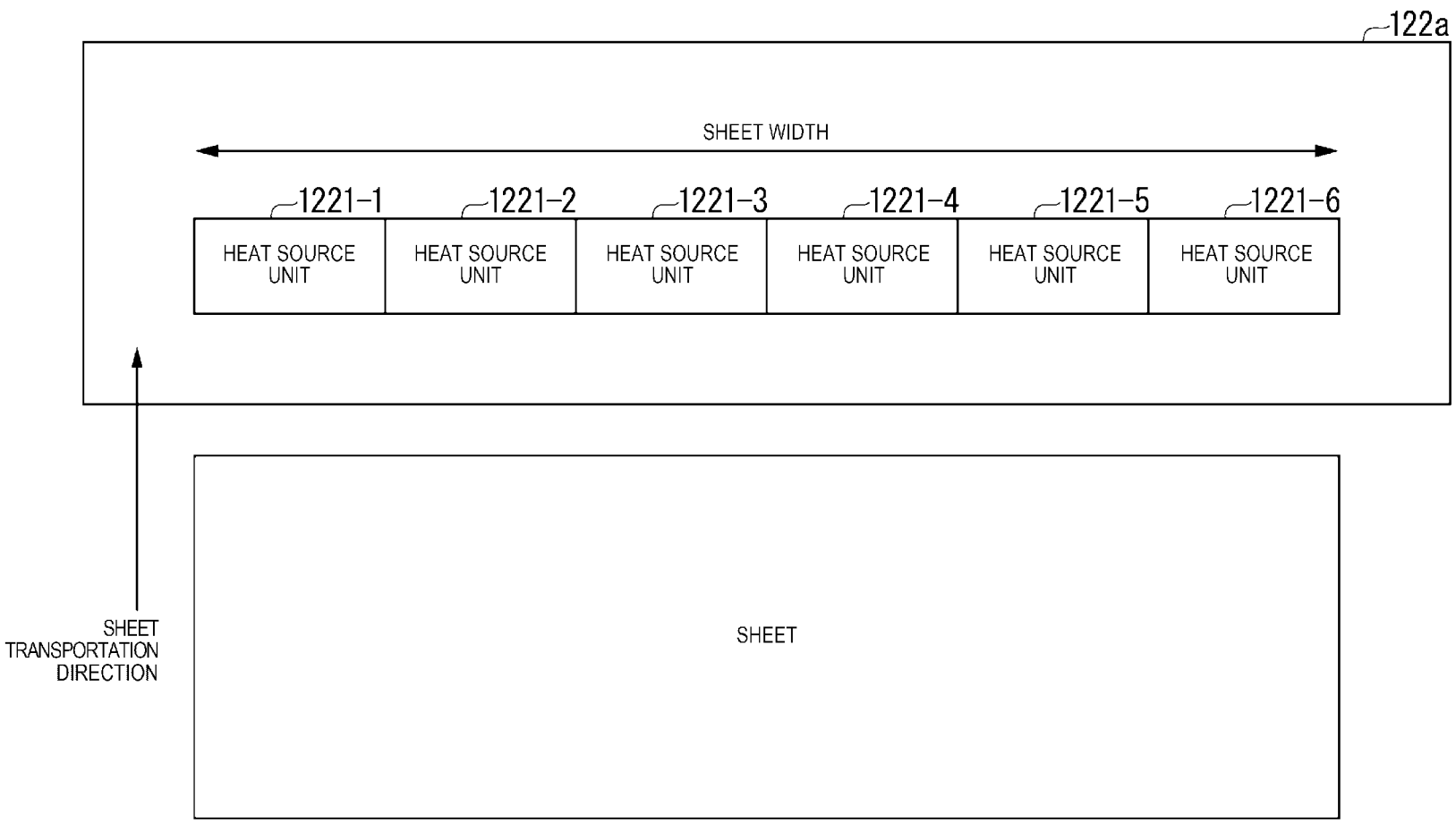
FIG. 19 is a diagram illustrating a specific example of a configuration of a fixing unit in the second embodiment.

FIG. 19 is a diagram illustrating a specific example of a configuration of the fixing unit 122*a* in the second embodiment.

The fixing unit 122*a* includes the heat source unit 1221-N (N is an integer that ranges from 1 to 6).

The heat source units 1221-1 to 1221-6 are arranged side by side without leaving space between each of the heat source units 1221-1 to 1221-6, in a direction that is perpendicular to the transportation direction of the sheet. A length L1 perpendicular to the transportation direction (hereinafter referred to as a "length L1"), of the heat source units 1221-1 to 1221-6, is shorter than a width L2 of the sheet. The length L1 may be any length as long as the length is such that 6×L1 is greater than L2 and (6−1)×L1 is smaller than L2. The heat source units 122-1 to 122-6 may have the same timing or different timings at which the sheet is heated and may have the same temperature or different temperature to which the sheet is heated.

It is noted that the number of heat source units 1221 that are included in the fixing unit 122*a* may not be necessarily 6. The number of heat source units 1221 that are included in the fixing unit 122*a* may be any number as long as the number is M (an integer that is equal to or greater than 2) that is equal to or greater than 2. If the number of heat source units 1221 that are included in the fixing unit 122*a* is M, the length L1 may be any length as long as the length is such that M×L1 is equal to or greater than L2 and (M−1)×L1 is smaller than L2.

A description is provided with reference again to FIG. 18. The control unit 20*a* controls each of the functional units of the image forming apparatus 1*a*.

Figure 20:
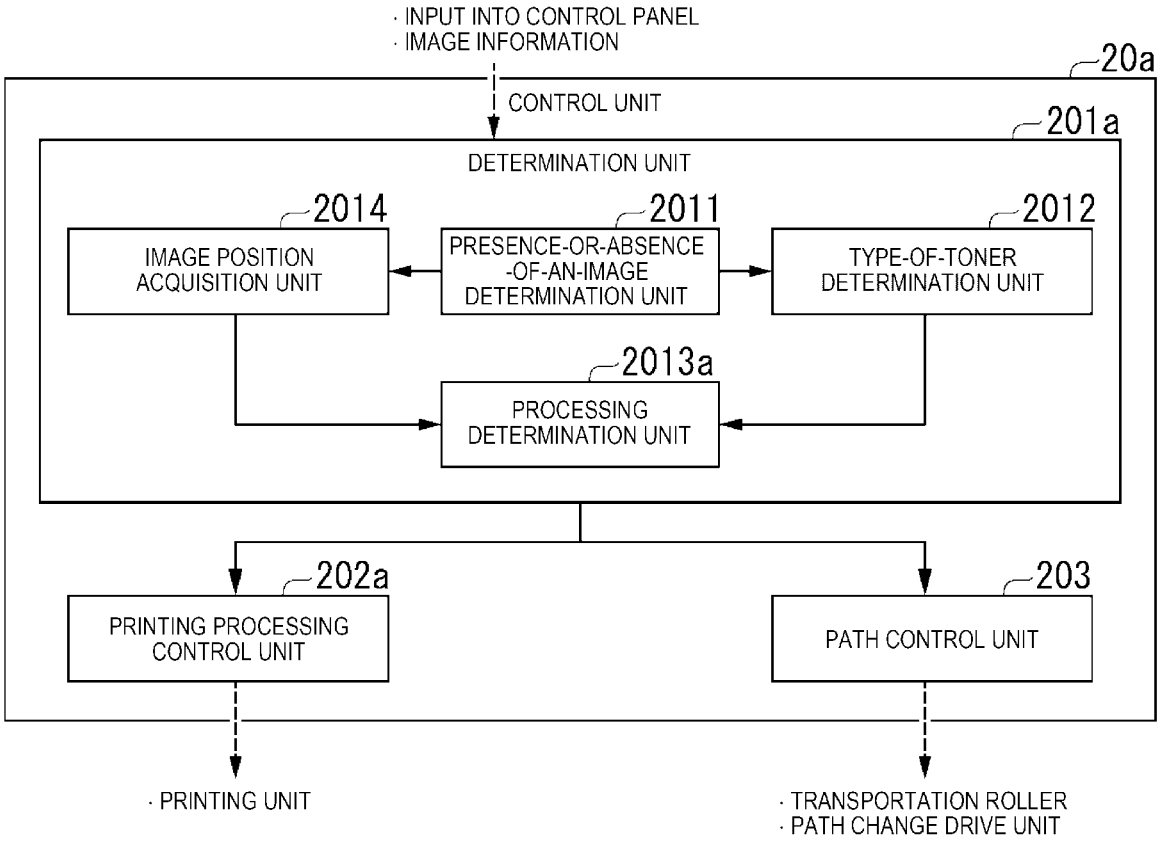
FIG. 20 is a diagram illustrating a specific example of a functional configuration of a control unit in the second embodiment.

FIG. 20 is a diagram illustrating a specific example of a functional configuration of the control unit 20*a* in the second embodiment. The control unit 20*a* is different from the control unit 20 in that a determination unit 201*a* is included instead of the determination unit 201 and in that the printing processing control unit 202*a* is included instead of the printing processing control unit 202.

The determination unit 201*a* is different from the determination unit 201 in that an image position acquisition unit 2014 is included and in that a processing determination unit 2013*a* is included instead of the processing determination unit 2013.

Based on the image information that is acquired by the image forming apparatus 1 itself, the image position acquisition unit 2014 acquires information (hereinafter referred to as "positional information") indicating a position of the image on the sheet, which is printed on the sheet.

Based on the input into the image forming apparatus 1 itself, the result of the determination by the presence-or-absence-of-an-image determination unit 2011, the result of the determination by the type-of-toner determination unit 2012, and the positional information that is acquired by the image position acquisition unit 2014, the processing determination unit 2013*a* determines the transportation path for the sheet, and individual operation each of the heat source units 1221-1 to 1221-6 of the fixing unit 122*a*.

The printing processing control unit 202*a* controls the fixing unit 122*a* in such a manner that the individual operation of each of the heat source units 1221-1 to 1221-6 of the fixing unit 122*a*, which is determined by the processing determination unit 2013*a*, is realized.

Figure 21:
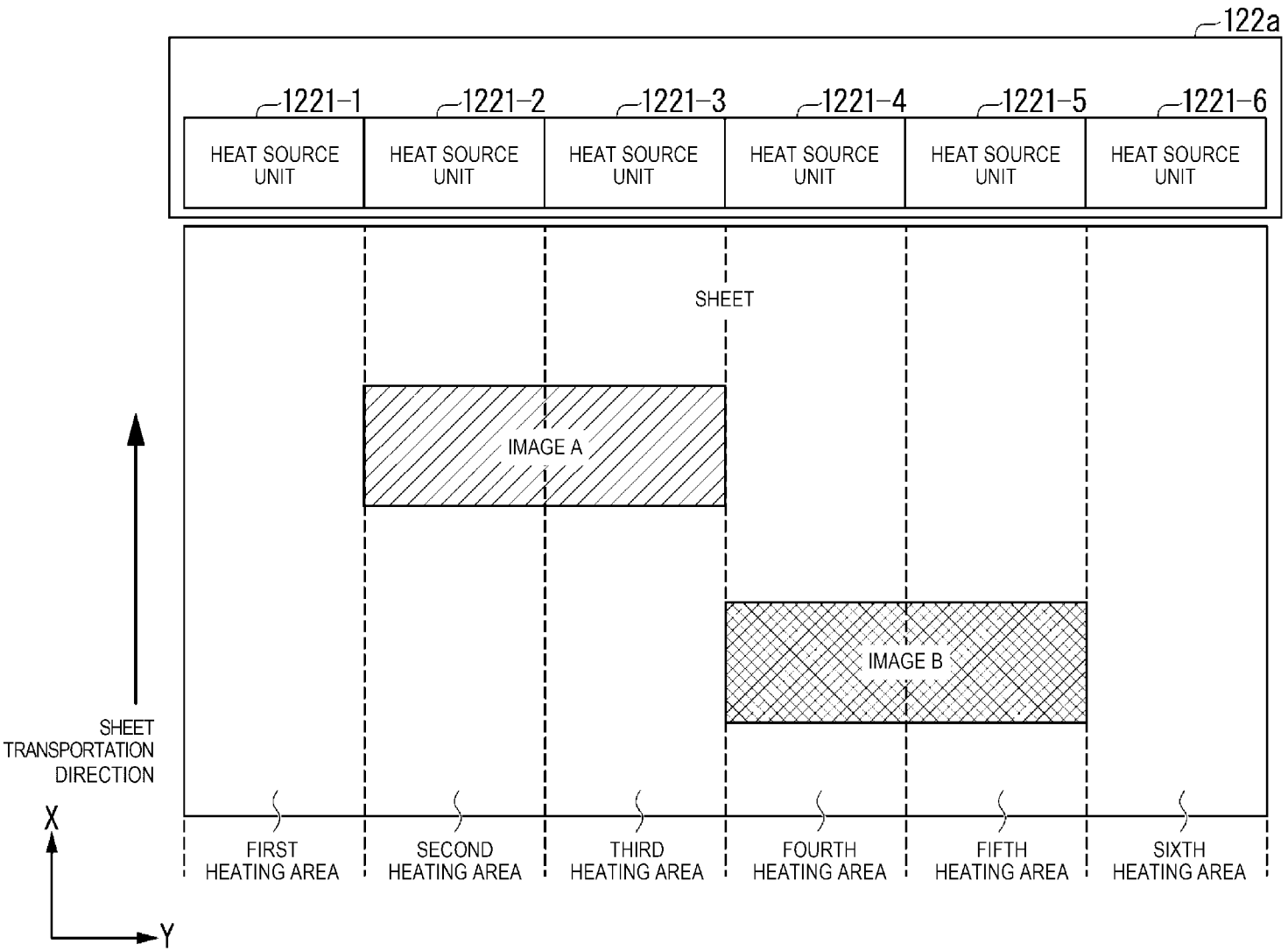
FIG. 21 is an explanatory diagram for describing a relationship between operation of each heat source unit and an image on a sheet in the second embodiment.

FIG. 21 is an explanatory diagram for describing a relationship between the operation of each of the heat source units 1221-1 to 1221-6 and the image on the sheet in the second embodiment. A first heat area in FIG. 21 is an area of the sheet, which is heated by the heat source unit 1221-1 of the fixing unit 122*a* to a prescribed temperature. A second heat area is an area of the sheet, which is heated by the heat source unit 1221-2 of the fixing unit 122*a* to the prescribed temperature. A third heat area is an area of the sheet, which is heated by the heat source unit 1221-3 of the fixing unit 122*a* to the prescribed temperature. A fourth heat area is an area of the sheet, which is heated by the heat source unit 1221-4 of the fixing unit 122*a* to the prescribed temperature. A fifth heat area is an area of the sheet, which is heated by the heat source unit 1221-5 of the fixing unit 122*a* to the prescribed temperature. A sixth heat area is an area of the sheet, which is heated by the heat source unit 1221-6 of the fixing unit 122*a* to the prescribed temperature. The prescribed temperature is the decolorization temperature or the fixing temperature. The first heat area, the second heat area, the third heat area, the fourth heat area, the fifth heat area, and the sixth heat area, if not individually distinguished, are hereinafter referred to as the heat area.

In FIG. 21, an image A and an image B are printed by the decolorable toner on the sheet. The image A is an image that is printed on the second heat area and the third heat area of the sheet. For this reason, the image A is decolorized by being heated by the heat source units 1221-2 and 1221-3 up to the decolorizing temperature. For this reason, the image forming apparatus 1*a* may operate only the heat source units 1221-2 and 1221-3 in order to decolorize the image A. The image B is an image that is printed on the fourth heat area and the fifth heat area of the sheet. For this reason, the image B is decolorized by being heated by the heat source units 1221-4 and 1221-5 up to the decolorizing temperature. For this reason, the image forming apparatus 1*a* may operate only the heat source units 1221-4 and 1221-5 in order to decolorize the image B. It is noted that the operating of the heat source unit 1221 is to individually supply power to each heat source unit 1221 in such a manner that the area corresponding to each heat source unit 1221 is heated to a prescribed temperature.

Furthermore, if an axis that is parallel to the transportation direction of the sheet and on which the transportation direction of the sheet is set to be a positive direction is defined as an X-axis, the image A and the image B are different from each other in the position on the X-axis, in which the printing is performed. The image A is positioned farther in the positive position on the X-axis than the image B. For this reason, the image A is transported earlier to the heat source unit 1221 than the image B. A point in time at which the image A reaches the heat source unit 1221 is assumed to be t0 for brief description, and a point in time at which the image B reaches the heat source unit 1221 is assumed to t1 for brief description. t1 is a later point in time than t0. First, the image forming apparatus 1*a* operates only the heat source units 1221-2 and 1221-3 at a point in time t0. Next, the image forming apparatus 1*a* operates only the heat source units 1221-2 and 1221-3 at a point in time t1. In this manner, an increase in the power that is consumed by the image forming apparatus 1*a* can be suppressed.

It is noted that the image A or the image B may not be an image that is printed by the decolorable toner. The image A or the image B may be an image that is formed by the image formation unit 121, and may be an image that has yet to be fixed by the fixing unit 122. In this case, based on the image information on the image that is input into the image forming apparatus 1 itself and the image information on the image that is printed by the image forming apparatus 1 itself, the image position acquisition unit acquires the positional information indicating the image-printed position on the sheet. The image information that is input into the image forming apparatus 1 itself may be image information that is input in any manner. The image information that is input into the image forming apparatus 1 itself, for example, may be image information that is input from an external apparatus through the communication unit 18, and may be image information that is output by the image reading unit 14.

Based on the positional information that is acquired by the image position acquisition unit, the image forming apparatus 1*a* operates the heat source unit 1221. Specifically, in order to fix the image A on the sheet, only the heat source units 1221-2 and 1221-3 may be operated. Furthermore, in order to fix the image B on the sheet B, the image forming apparatus 1*a* may operate only the heat source unit 1221-4 and 1221-5.

Figure 22:
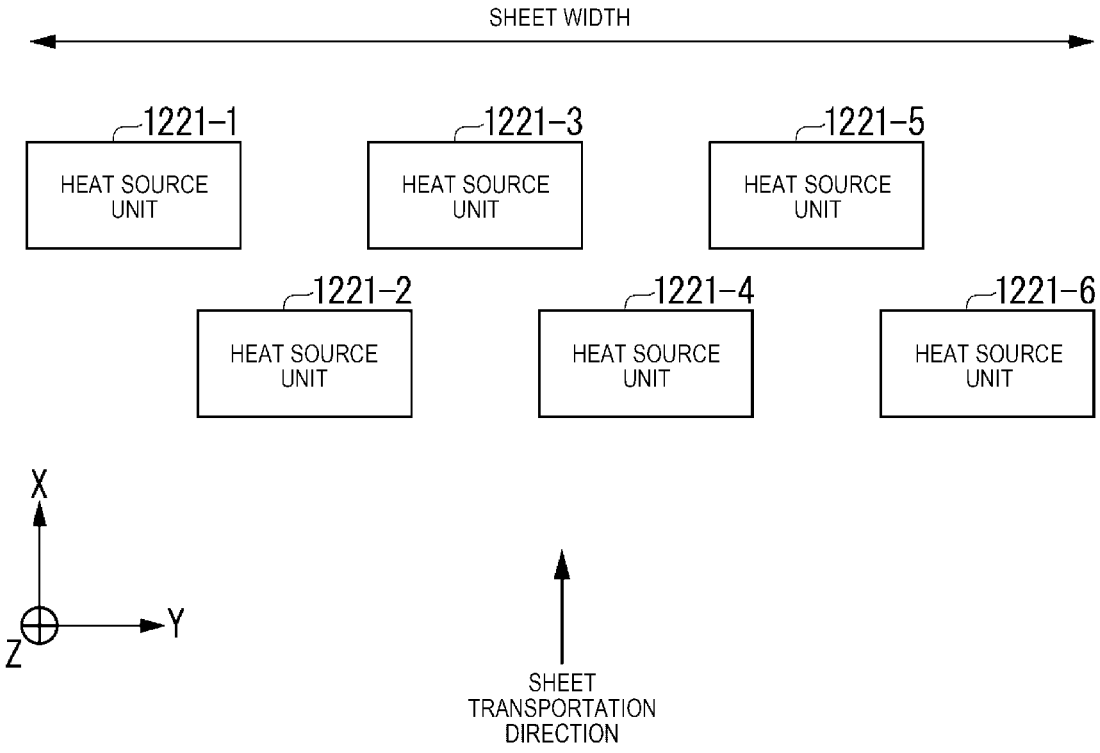
FIG. 22 is a diagram illustrating a specific example of a method of arranging heat source units in the second embodiment.

FIG. 22 is a diagram illustrating a specific example of a method of arranging the heat source units 1221 in the second embodiment. The heat source units 1221-1 and 1221-6 may be arranged in any manner as long as the sheet is possibly heated without leaving space between each of the heat source units 1221-1 and 1221-6. For example, as illustrated in FIG. 21, the arrangement of the heat source units 1221-1 to 1221-6 may be an arrangement in which one or several of the heat source units 1221 overlaps a heat source unit 1221.

Because the image forming apparatus 1*a* according to the second embodiment, which is configured in this manner, includes a plurality of heat source units 1221 that are individually controlled, only a portion of the sheet, which needs to be heated, can be heated. For this reason, energy consumption that accompanies the printing or the decolorizing of the image can be suppressed.

MODIFICATION EXAMPLE

Based on the density of the image that is printed by the decolorable toner on the sheet, the processing determination units 2013 and 2013*a* may determine the operation of the heat source unit 1221. Specifically, the operation of the heat source unit 1221 is an operation in which the heat source unit 1221 provides a prescribed amount of heat to the sheet. If the density on the sheet is low, the processing determination units 2013 and 2013*a* determines to operate the heat source unit 1221 in such a manner that the amount of heat that is provided to the sheet is small. Adjustment of the amount of heat is realized by a heating time or a heating temperature. The processing determination unit 2013*a* may determine that a temperature of the individual heat source unit 1221 changes according to the density. The operation of the heat source unit 1221, which is determined by the processing determination units 2013 and 2013*a*, is realized by the printing processing control units 202 and 202*a*, respectively.

The image forming apparatus 1 and 1*a* do not necessarily distribute sheets to three paper discharge destinations. If the image decolorization instruction is input, the image forming apparatuses 1 and 1*a*, for example, may distribute sheets only to the first decolorization-time transportation path and the second decolorization-time transportation path. In this case, if the following two conditions are satisfied, the image forming apparatuses 1 and 1*a* may transport the sheet along the first decolorization-time transportation path. In other cases, the image forming apparatuses 1 and 1*a* may transport the sheet along the second decolorization-time transportation path. The first one of the two conditions is that a result of the determination by the presence-or-absence-of-an-image determination unit is a result of the determination showing that an image is printed on the sheet. The second one of the two conditions is that a result of the determination by the type-of-toner determination unit is a result of the determination showing that an image which results from the decolorable toner is printed on the sheet.

Furthermore, if an image formation instruction is input, the image forming apparatuses 1 and 1*a*, for example, may distribute sheets only to the first decolorization-time transportation path and the second decolorization-time transportation path. In this case, if the following condition is satisfied, the image forming apparatuses 1 and 1*a* may transport the sheet along the first printing-time transportation path. If the following condition is not satisfied, the image forming apparatuses 1 and 1*a* may transport the sheet along the second printing-time transportation path. The condition is that a result of the determination by the presence-or-absence-of-an-image determination unit is a result of the determination showing that an image is not printed on the sheet.

The image acquisition unit 132 does not necessarily need to be included in the accommodation tray 131. The image acquisition unit 132 may be located in any position as long as the position satisfies the following two conditions. The first one of the two conditions is that, if the instruction to print the image is input into the image forming apparatus 1 itself, the image acquisition unit 132 is present in a position in which the image on the sheet is optically readable until before the image formation unit 121 starts to form the image on the sheet. The second one of the two conditions is that, if the instruction to decolorize the image is input into the image forming apparatus 1 itself, the image acquisition unit 132 is present in a position in which the image on the sheet is optically readable until before the fixing unit 122 starts to heat the sheet.

Figure 23:
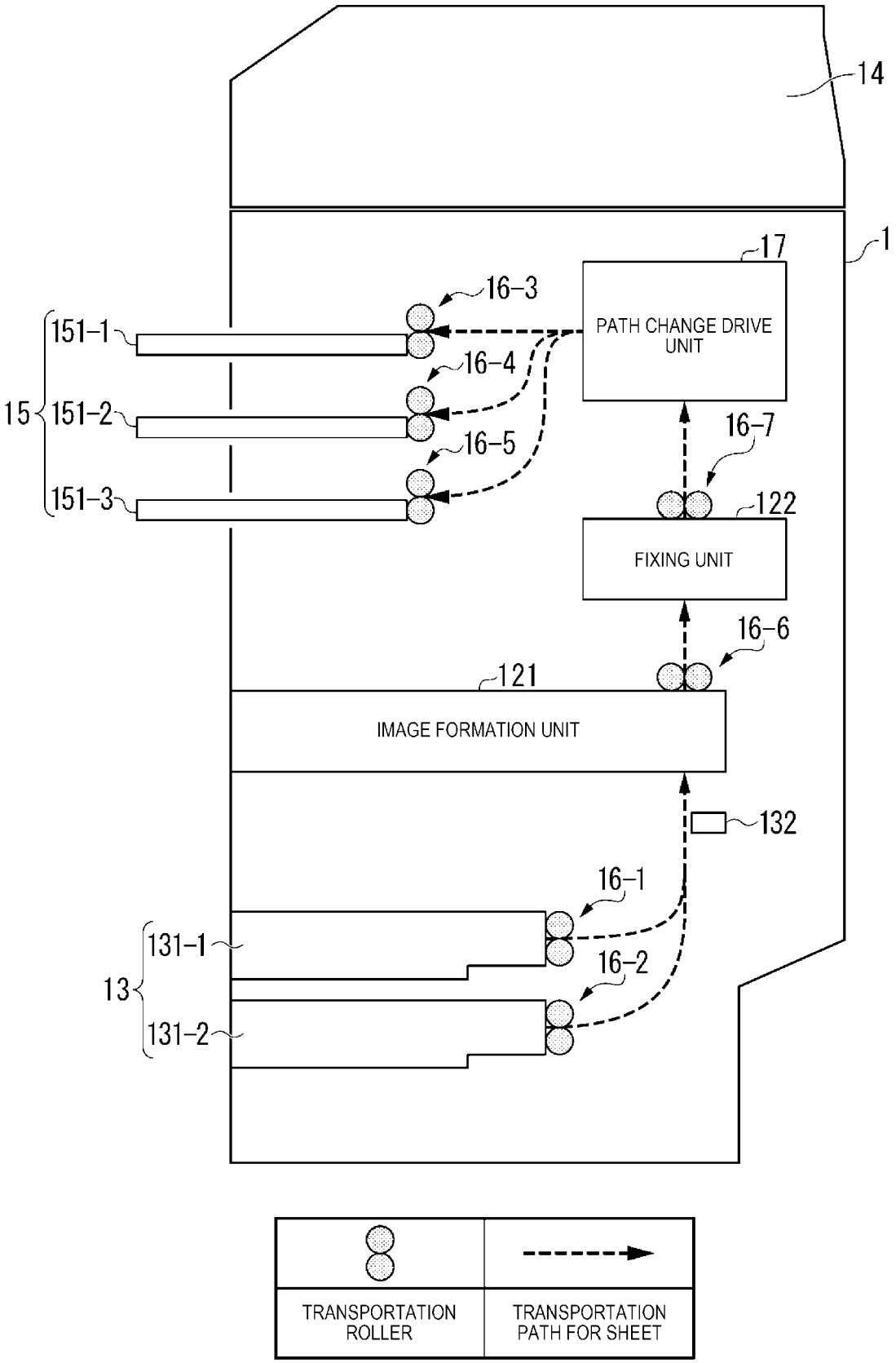
FIG. 23 is an explanatory diagram for describing specific positioning of an image acquisition unit in a modification example.

FIG. 23 is an explanatory diagram for describing specific positioning of the image acquisition unit 132 in the modification example. In FIG. 23, the image acquisition unit 132 is located in a position in which the sheet which is transported along the transportation path from the accommodation tray 131 to the image formation unit 121 is readable.

Furthermore, the image forming apparatuses 1 and 1*a* do not necessarily need to acquire an image on one sheet using one image acquisition unit 132. The image forming apparatuses 1 and 1*a*, for example, may acquire an image on one sheet using a plurality of image acquisition units 132.

Figure 24:
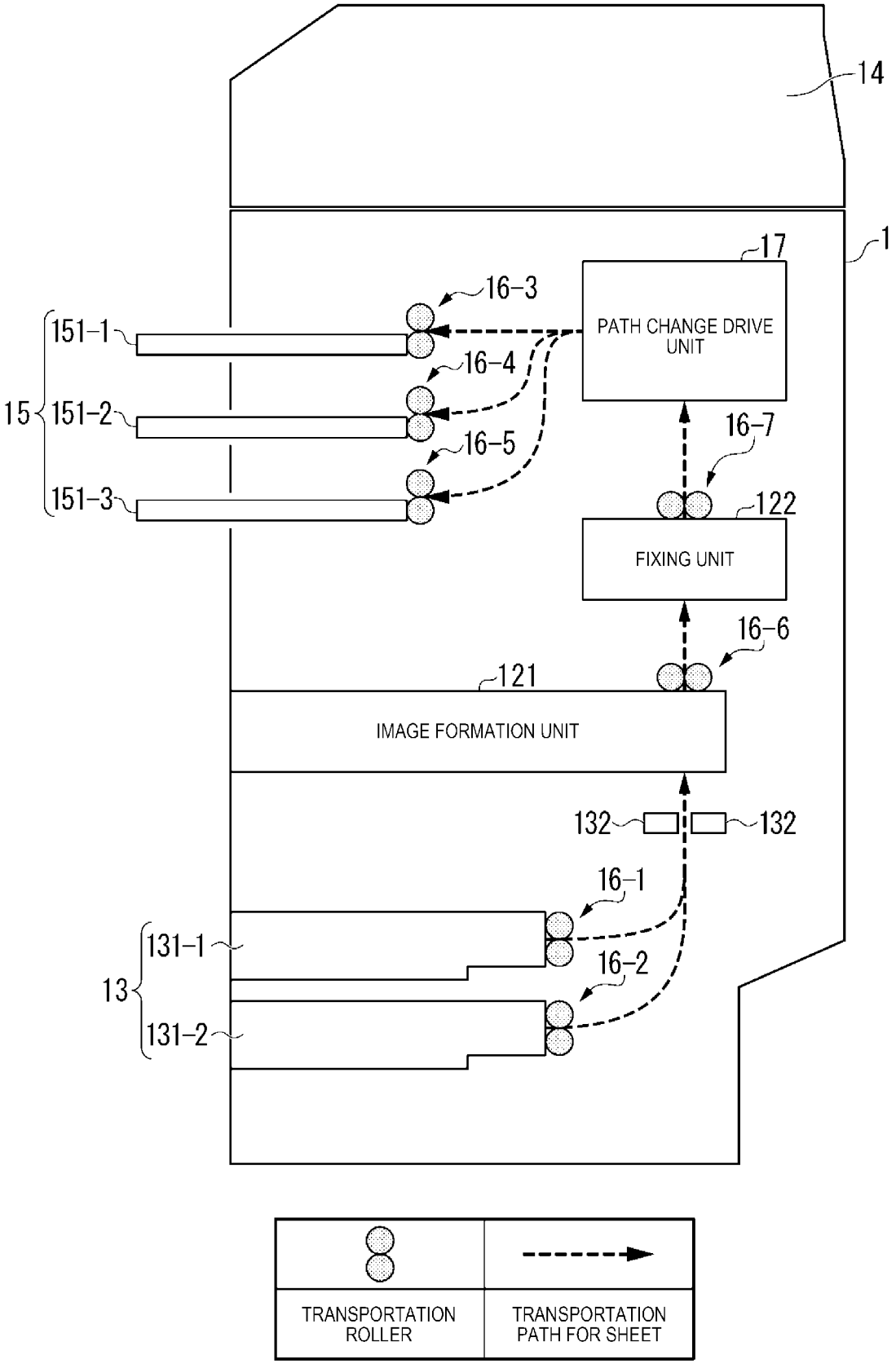
FIG. 24 is an explanatory diagram for describing a specific arrangement of a plurality of image acquisition units in the modification example.

FIG. 24 is an explanatory diagram for describing a specific arrangement of a plurality of image acquisition units 132 in the modification example. Two image acquisition units 132 are arranged in the position in which the sheet which is transported along the transportation path from the accommodation tray 131 to the image formation unit 121 is readable. Two image acquisition units 132 are arranged in a manner that faces each other, with the sheet being interposed therebetween. The image acquisition units 132 that are arranged in this manner can acquire images on the front surface and the rear surface of the sheet.

The image forming apparatuses 1 and 1*a* do not need to have only the transportation path that necessarily passes through the image formation unit 121, as the transportation path for the sheet. The image forming apparatuses 1 and 1*a*, for example, may have the transportation path along which the sheet is transported through a space in which the image formation unit 121 is not present. The transportation path that does not pass through the image formation unit 121 is hereinafter referred to as a non-passing-through-an-image-formation-unit path. Because this transportation path does not pass through the image formation unit 121, poor functioning of the image formation unit 121 due to generation of a jam that results from the transportation of the sheet can be suppressed.

Figure 25:
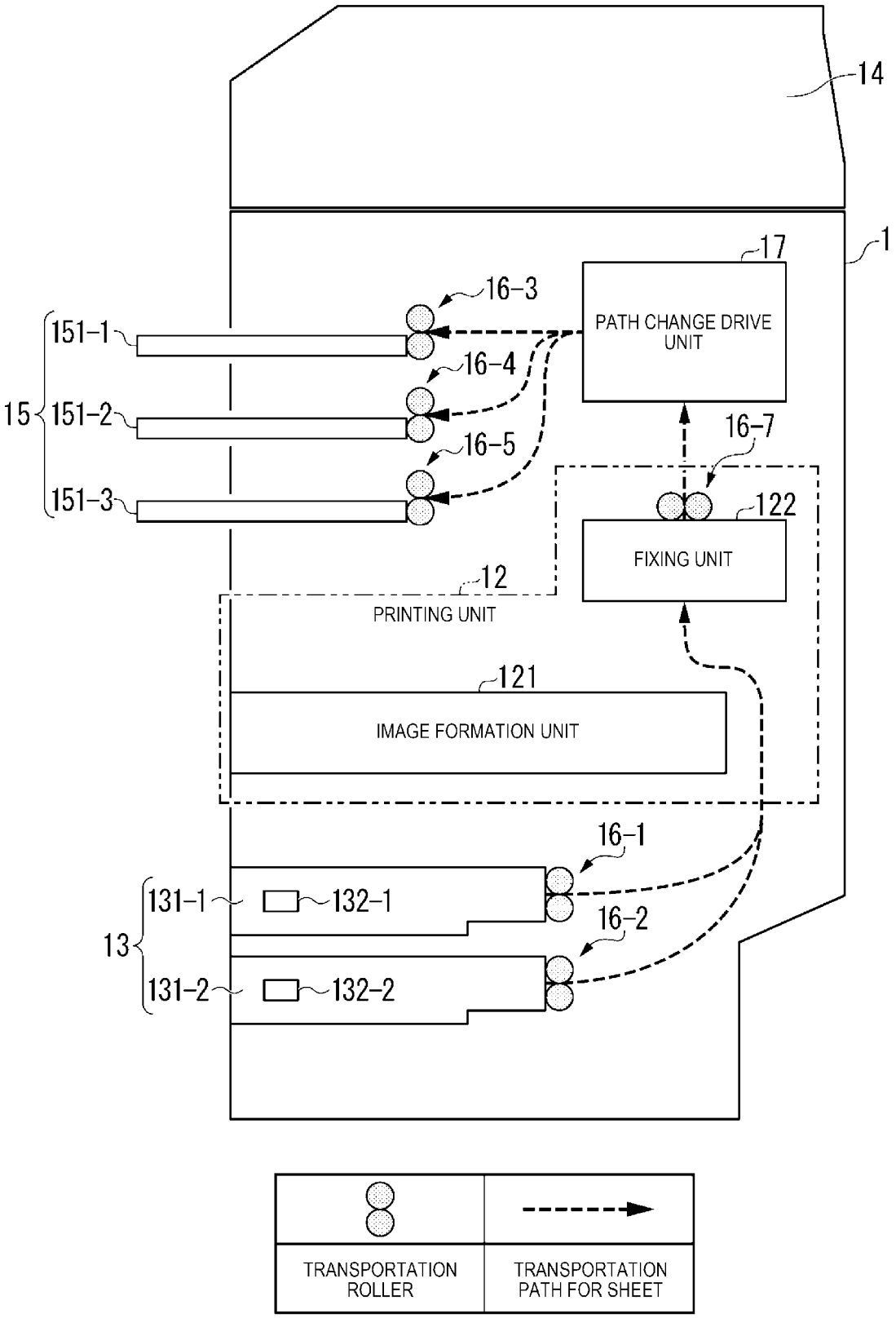
FIG. 25 is a diagram illustrating a specific example of a non-passing-through-an-image-formation-unit path in the modification example.

FIG. 25 is a diagram illustrating a specific example of the non-passing-through-an-image-formation-unit path in the modification example.

Along the non-passing-through-an-image-formation-unit path, the sheet that is accommodated in the accommodation tray 131-1 or 131-2 is transported by the transportation roller 16 to the fixing unit 122, instead of the image formation unit 121. The sheet that is transported to the fixing unit 122 is discharged by the transportation roller 16 to the paper discharge tray 151.

The image forming apparatuses 1 and 1*a* do not need to have only the transportation path that necessarily passes through the fixing unit 122, as the transportation path for the sheet. The image forming apparatuses 1 and 1*a*, for example, may have the transportation path along which the sheet is transported through a space in which the fixing unit 122 is not present. The transportation path that does not pass through the fixing unit 122 is hereinafter referred to as a non-passing-through-a-fixing-unit path. Because this transportation path does not pass through the fixing unit 122, poor functioning of the fixing unit 122 due to the generation of the jam that results from the transportation of the sheet can be suppressed.

Figure 26:
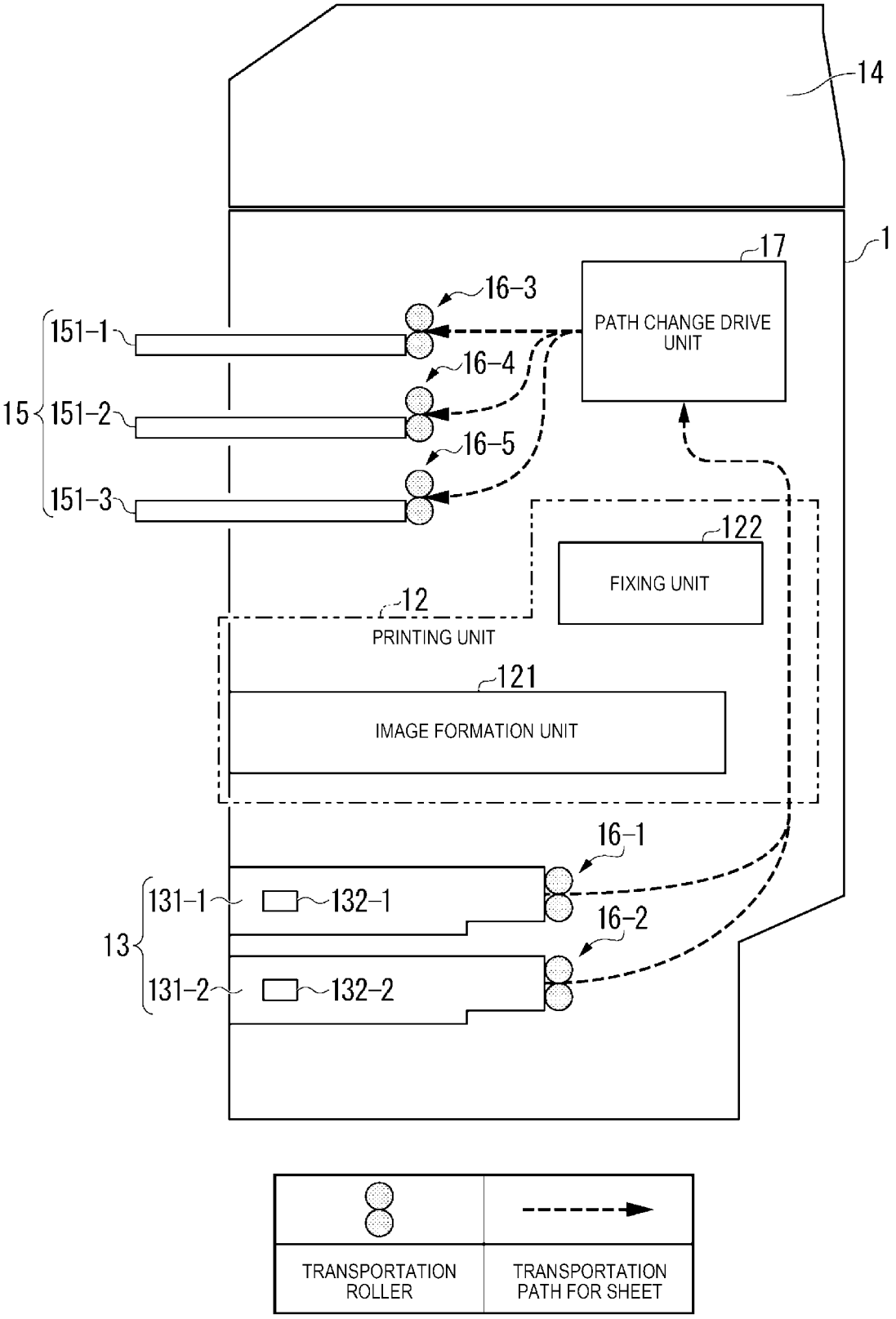
FIG. 26 is a diagram illustrating a specific example of a non-passing-through-a-fixing-unit path in the modification example.

FIG. 26 is a diagram illustrating a specific example of the non-passing-through-a-fixing-unit path in the modification example.

Along the non-passing-through-a-fixing-unit path, the sheet that is accommodated in the accommodation tray 131-1 or 131-2 is discharged by the transportation roller 16 to the paper discharge tray 151 without being transported to the image formation unit 121 and the fixing unit 122.

Three paper discharge trays do not necessarily need to be present on the same flank surface of the image forming apparatuses 1 and 1*a*. As long as three paper discharge trays in total are present, the three trays may be located in any position.

Figure 27:
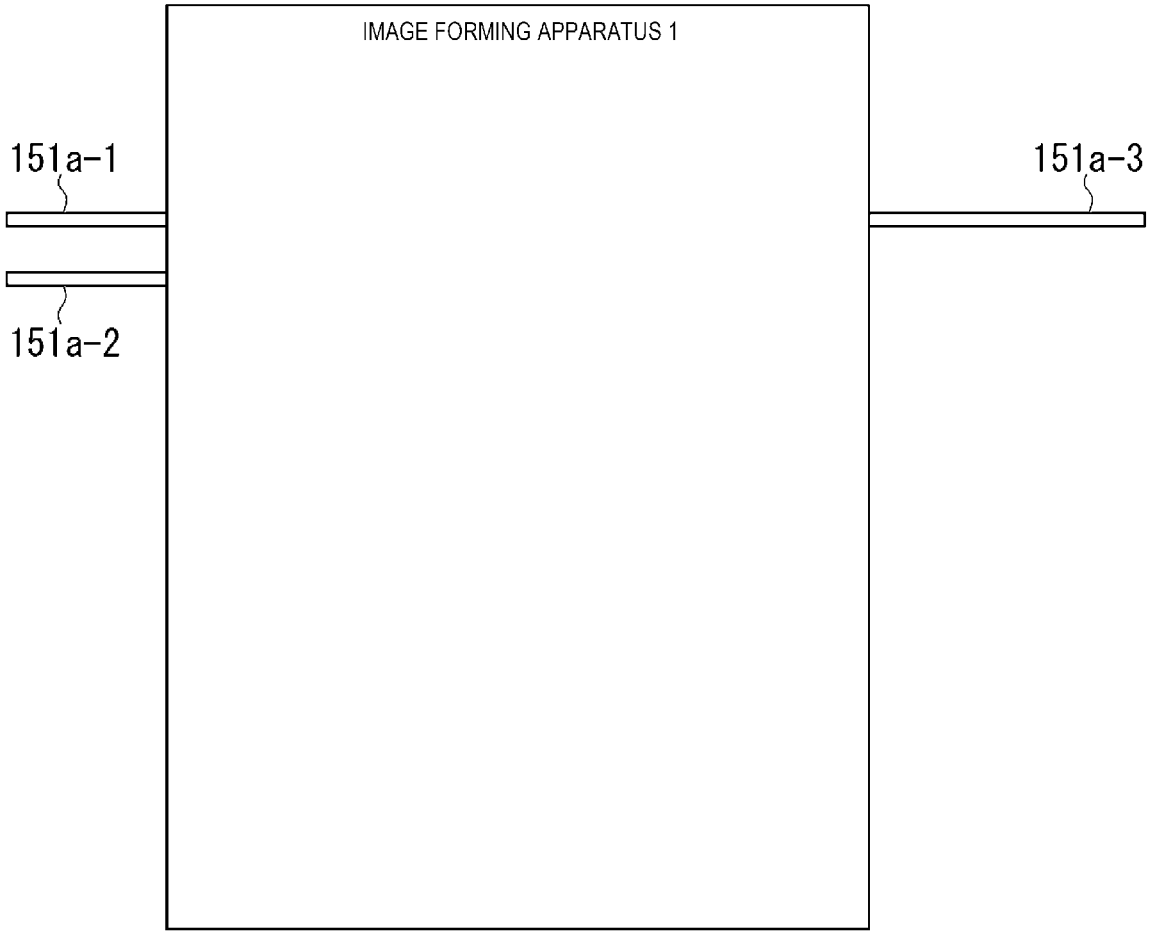
FIG. 27 is a diagram illustrating a specific arrangement of paper discharge trays in the modification example.

FIG. 27 is a diagram illustrating a specific arrangement of the paper discharge trays 151*a*-1 to 151*a*-3 in the modification example.

The paper discharge trays 151*a*-1 and the paper discharge tray 151*a*-2, and the paper discharge tray 151*a*-3 are included in opposite flank surfaces, respectively, of the image forming apparatus 1.

It is noted that all portions, or one or several of each function of each of the image forming apparatus 1 and 1*a* may be realized using a piece of hardware, such as an application-specific integrated circuit (ASIC), a programmable logic device (PLD), or a field programmable gate array (FPGA). The program may be recorded on a computer-readable recording medium. For example, the "computer-readable recording medium" refers to a portable medium, such as a flexible disk, a magneto-optical disk, a ROM, and a CD-ROM, and a storage device, such as a hard disk, that is built into a computer system. The program may be transmitted through an electric telecommunication line.

It is noted that the transportation roller 16 is an example of the roller. The processing determination unit 2013 is an example of the determination unit. The printing processing control unit 202 is an example of a heating processing control unit. The fixing unit 122 is an example of the heating unit.

It is noted that the first decolorization-time transportation path is an example of a first transportation path. The second decolorization-time transportation path is an example of a second transportation path, and the third decolorization-time transportation path is an example of a third transportation path. The first printing-time transportation path is an example of a fourth transportation path. The second printing-time transportation path is an example of a fifth transportation path. The third printing-time transportation path is an example of a sixth transportation path.

Based on the presence or absence of the image on the sheet, the image forming apparatuses 1 and 1*a* according to at least one embodiment, which is described above, control the supply of the power for the heating to the heat source unit 1221. For this reason, energy consumption that accompanies the printing or the decolorizing of the image can be suppressed.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A decolorization apparatus comprising:

an image acquisition unit configured to optically read an image on a sheet;

a heating unit configured to heat the sheet;

a presence-or-absence-of-an-image determination unit configured to determine whether or not the image is printed on the sheet, based on the image that is read by the image acquisition unit;

an image formation unit configured to form the image on the sheet using one or both of a decolorable toner that is decolorized by heating the sheet to a prescribed temperature or above and a non-decolorable toner that is not decolorized although the sheet is heated to the prescribed temperature or above;

a determination unit configured to determine whether or not to supply power for heating the sheet to the heating unit, depending on determination of whether or not an instruction for the sheet to be heated by the heating unit to a temperature at which the decolorable toner is decolorized is input and additionally on determination by the presence-or-absence-of-an-image determination unit of whether or not the image is printed on the sheet;

a heating control unit configured to control the heating unit based on the determination by the determination unit;

a type-of-toner determination unit configured to determine whether the image is printed by the decolorable toner on the sheet or the image is printed by the non-decolorable toner on the sheet, based on the image on the sheet that is read by the image acquisition unit;

a roller configured to transport the sheet;

a plurality of paper discharge destinations to which the sheet is discharged; and an input unit configured to receive input of a decolorization instruction, wherein the determination unit determines that the power for heating the sheet is not supplied to the heating unit, if a result of the determination by the type-of-toner determination unit is a result showing that an image which results from the non-decolorable toner is printed, when the instruction for the sheet to be heated by the heating unit to the temperature at which the decolorable toner is decolorized is input into the apparatus itself, wherein the roller forms a plurality of transportation paths along which the sheet is transported, wherein the determination unit additionally determines a transportation path along which the sheet is transported by the roller, based on a result of the determination by the presence-or-absence-of-an-image determination unit, wherein the roller forms the plurality of transportation paths along which the sheet is transported to the paper discharge destination, wherein the determination unit determines the transportation path along which the sheet is transported, as a first transportation path, if a result of the determination by the presence-or-absence-of-an-image determination unit is a result of the determination showing that the image is printed on the sheet and additionally, the result of the determination by the type-of-toner determination unit is a result showing that an image which results from the decolorable toner is printed on the sheet, when the instruction for the sheet to be heated by the heating unit to the temperature at which the decolorable toner is decolorized is input from the input unit;

wherein the determination unit determines the transportation path for the sheet, as a second transportation path along which the sheet is discharged to a paper discharge destination that is different from the paper discharge destination to which the sheet is discharged along the first transportation path, if the instruction for the sheet to be heated by the heating unit to the temperature at which the decolorable toner is decolorized is input into the apparatus itself and, additionally, the result of the determination by the presence-or-absence-of-an-image determination unit is a result of the determination showing that the image is not printed on the sheet, and if the result of the determination by the presence-or-absence-of-an-image determination unit is the result of the determination showing that the image is printed on the sheet, and additionally, the result of the determination by the type-of-toner determination unit is a result showing that the image which results from the non-decolorable toner is printed on the sheet, when the instruction for the sheet to be heated by the heating unit to the temperature at which the decolorable toner is decolorized is input into the apparatus itself, wherein the determination unit determines the transportation path for the sheet, as the second transportation path, if the result of the determination shows that the image is printed on the sheet and additionally, the result of the determination by the type-of-toner determination unit is the result of the determination that the image which results from the non-decolorable toner is printed on the sheet, when the instruction for the sheet to be heated by the heating unit to the temperature at which the decolorable toner is decolorized is input from the input unit, and wherein the determination unit determines the transportation path for the sheet, as a third transportation path along which the sheet is discharged to a paper discharge destination that is different from both of the paper discharge destination to which the sheet is discharged along the first transportation path and the paper discharge destination to which the sheet is discharged along the second transportation path, when the instruction for the sheet to be heated by the heating unit to the temperature at which the decolorable toner is decolorized is input into the apparatus itself and additionally, the result of the determination by the presence-or-absence-of-an-image determination unit is the result of the determination showing that the image is not printed on the sheet.

2. The apparatus according to claim 1, further comprising:

a sheet accommodation unit configured to accommodate the sheet, wherein the image acquisition unit is located in a position in which the image that is formed on the sheet which is accommodated in the sheet accommodation unit is optically readable.

3. The apparatus according to claim 1, wherein the image acquisition unit is located in a position in which the image on the sheet is optically readable until the heating unit starts to heat the sheet.

4. A decolorization apparatus comprising:

an image acquisition unit configured to optically read an image on a sheet;

a heating unit configured to heat the sheet;

a presence-or-absence-of-an-image determination unit configured to determine whether or not the image is printed on the sheet, based on the image that is read by the image acquisition unit;

an image formation unit configured to form the image on the sheet using one or both of a decolorable toner that is decolorized by heating the sheet to a prescribed temperature or above and a non-decolorable toner that is not decolorized although the sheet is heated to the prescribed temperature or above;

a determination unit configured to determine whether or not to supply power for heating the sheet to the heating unit, depending on determination of whether or not an instruction for the sheet to be heated by the heating unit to a temperature at which the decolorable toner is decolorized is input and additionally on determination by the presence-or-absence-of-an-image determination unit of whether or not the image is printed on the sheet;

a heating control unit configured to control the heating unit based on the determination by the determination unit;

a type-of-toner determination unit configured to determine whether the image is printed by the decolorable toner on the sheet or the image is printed by the non-decolorable toner on the sheet, based on the image on the sheet that is read by the image acquisition unit;

a roller configured to transport the sheet; and an input unit configured to receive input of a decolorization instruction, wherein the determination unit determines that the Dower for heating the sheet is not supplied to the heating unit, if a result of the determination by the type-of-toner determination unit is a result showing that an image which results from the non-decolorable toner is printed, when the instruction for the sheet to be heated by the heating unit to the temperature at which the decolorable toner is decolorized is input into the apparatus itself, wherein the roller forms a plurality of transportation paths along which the sheet is transported, wherein the determination unit additionally determines a transportation path along which the sheet is transported by the roller, based on a result of the determination by the presence-or-absence-of-an-image determination unit, wherein the roller forms the transportation path along which the sheet is transported to a prescribed paper discharge destination without being transported to the heating unit, and wherein the determination unit determines the transportation path for the sheet, as a transportation path along which the sheet is transported to the prescribed paper discharge destination without being transported to the heating unit, if a result of the determination shows that the image is printed on the sheet and additionally, a result of the determination by the type-of-toner determination unit is a result of the determination showing that an image which results from the non-decolorable toner is printed on the sheet, when the instruction for the sheet to be heated by the heating unit to the temperature at which the decolorable toner is decolorized is input into the apparatus itself, and if the instruction for the sheet to be heated by the heating unit to the temperature at which the decolorable toner is decolorized is input into the apparatus itself and additionally, a result of the determination by the presence-or-absence-of-an-image determination unit is a result of the determination showing that the image is not printed on the sheet.

5. The apparatus according to claim 4, further comprising:

a sheet accommodation unit configured to accommodate the sheet, wherein the image acquisition unit is located in a position in which the image that is formed on the sheet which is accommodated in the sheet accommodation unit is optically readable.

6. The apparatus according to claim 4, wherein the image acquisition unit is located in a position in which the image on the sheet is optically readable until the heating unit starts to heat the sheet.

7. An image forming apparatus comprising:

an image acquisition unit configured to optically read an image on a sheet;

a heating unit configured to heat the sheet;

a presence-or-absence-of-an-image determination unit configured to determine whether or not the image is printed on the sheet, based on the image that is read by the image acquisition unit;

an image formation unit configured to form the image on the sheet using one or both of a decolorable toner that is decolorized by heating the sheet to a prescribed temperature or above and a non-decolorable toner that is not decolorized although the sheet is heated to the prescribed temperature or above;

a determination unit configured to determine whether or not to supply power that makes the printing of the image on the sheet possible to the image information unit or the heating unit, depending on determination of whether or not an instruction for the image to be printed by the decolorable toner or the non-decolorable toner on the sheet is input and additionally on determination by the image information unit of whether or not the image is printed on the sheet;

a heating control unit configured to control the image formation unit and the heating unit based on the determination by the determination unit;

a type-of-toner determination unit configured to determine whether the image is printed by the decolorable toner on the sheet or the image is printed by the non-decolorable toner on the sheet, based on the image on the sheet that is read by the image acquisition unit;

a roller configured to transport the sheet; and a plurality of paper discharge destinations to which the sheet is discharged, wherein the roller forms a plurality of transportation paths along which the sheet is transported, wherein the determination unit additionally determines a transportation path along which the sheet is transported by the roller, based on a result of the determination by the presence-or-absence-of-an-image determination unit, wherein the roller forms a plurality of transportation paths along with the sheet is transported to the paper discharge destination, wherein the determination unit determines the transportation path for the sheet, as a first transportation path, if a result of the determination by the presence-or-absence-of-an-image determination unit is a result of the determination showing that the image is not printed on the sheet, when an instruction for the image to be printed by the decolorable toner or the non-decolorable toner on the sheet is input into the apparatus itself, wherein the determination unit determines the transportation path for the sheet, as a second transportation path along which the sheet is discharged to a paper discharge destination that is different from a paper discharge destination to which the sheet is discharged along the fourth transportation path, if the result of the determination by the presence-or-absence-of-an-image determination unit is the result of the destination showing that the image is printed on the sheet, when the instruction for the image to be printed by the decolorable toner or the non-decolorable toner on the sheet is input into the apparatus itself, wherein the determination unit determines the transportation path for the sheet, as the second transportation path, if the result of the determination by the presence-or-absence-of-an-image determination unit is the result of the determination showing that the image is printed on the sheet and additionally, a result of the determination by the type-of-toner determination unit is a result of the determination showing that an image which results from the non-decolorable toner is printed on the sheet, when the instruction for the image to be printed by the decolorable toner or the non-decolorable toner on the sheet is input into the apparatus itself, and wherein the determination unit determines the transportation path for the sheet, as a third transportation path along which the sheet is discharged to a paper discharge destination that is different from both of a paper discharge destination to which the sheet is discharged along the fourth transportation path and a paper discharge destination to which the sheet is discharged along the fifth transportation path, if the result of the determination by the presence-or-absence-of-an-image determination unit is the result of the determination showing that the image is printed on the sheet and additionally, the result of the determination by the type-of-toner determination unit is a result of the determination showing that an image which results from the decolorable toner is printed on the sheet, when the instruction for the image to be printed by the decolorable toner or the non-decolorable toner on the sheet is input into the apparatus itself.

8. The apparatus according to claim 7, further comprising:

a sheet accommodation unit configured to accommodate the sheet, wherein the image acquisition unit is located in a position in which the image that is formed on the sheet which is accommodated in the sheet accommodation unit is optically readable.

9. The apparatus according to claim 7, wherein the image acquisition unit is located in a position in which the image on the sheet is optically readable until the image formation unit starts to form the image on the sheet.

10. An image forming apparatus comprising:

an image acquisition unit configured to optically read an image on a sheet;

a heating unit configured to heat the sheet;

a presence-or-absence-of-an-image determination unit configured to determine whether or not the image is printed on the sheet, based on the image that is read by the image acquisition unit;

an image formation unit configured to form the image on the sheet using one or both of a decolorable toner that is decolorized by heating the sheet to a prescribed temperature or above and a non-decolorable toner that is not decolorized although the sheet is heated to the prescribed temperature or above;

a determination unit configured to determine whether or not to supply power that makes the printing of the image on the sheet possible to the image information unit or the heating unit, depending on determination of whether or not an instruction for the image to be printed by the decolorable toner or the non-decolorable toner on the sheet is input and additionally on determination by the image information unit of whether or not the image is printed on the sheet;

a heating control unit configured to control the image formation unit and the heating unit based on the determination by the determination unit;

a type-of-toner determination unit configured to determine whether the image is printed by the decolorable toner on the sheet or the image is printed by the non-decolorable toner on the sheet, based on the image on the sheet that is read by the image acquisition unit; and a roller configured to transport the sheet, wherein the roller forms a plurality of transportation paths along which the sheet is transported, wherein the determination unit additionally determines a transportation path along which the sheet is transported by the roller, based on a result of the determination by the presence-or-absence-of-an-image determination unit, wherein the roller forms a transportation path along which the sheet is transported to a prescribed paper discharge destination without being transported to the heating unit, and wherein the determination unit determines the transportation path along which the sheet is discharged to the prescribed paper discharge destination without being transported to the heating unit, if a result of the determination by the presence-or-absence-an-image determination unit is a result of the determination showing that the image is printed on the sheet, when an instruction for the image to be printed by the decolorable toner or the non-decolorable toner on the sheet is input into the apparatus itself.

11. The apparatus according to claim 10, further comprising:

a sheet accommodation unit configured to accommodate the sheet, wherein the image acquisition unit is located in a position in which the image that is formed on the sheet which is accommodated in the sheet accommodation unit is optically readable.

12. The apparatus according to claim 10, wherein the image acquisition unit is located in a position in which the image on the sheet is optically readable until the image formation unit starts to form the image on the sheet.

13. A decolorization apparatus comprising:

an image acquisition unit configured to optically read an image on a sheet;

a heating unit configured to heat the sheet;

a presence-or-absence-of-an-image determination unit configured to determine whether or not the image is printed on the sheet, based on the image that is read by the image acquisition unit;

an image formation unit configured to form the image on the sheet using one or both of a decolorable toner that is decolorized by heating the sheet to a prescribed temperature or above and a non-decolorable toner that is not decolorized although the sheet is heated to the prescribed temperature or above;

a determination unit configured to determine whether or not to supply power for heating the sheet to the heating unit, depending on determination of whether or not an instruction for the sheet to be heated by the heating unit to a temperature at which the decolorable toner is decolorized is input and additionally on determination by the presence-or-absence-of-an-image determination unit of whether or not the image is printed on the sheet;

a heating control unit configured to control the heating unit based on the determination by the determination unit; and an image position acquisition unit configured to acquire information indicating a position of the image that is printed on the sheet, on the sheet, based on the image on the sheet that is read by the image acquisition unit, wherein the heating unit includes a plurality of heat source units, wherein the heating control unit individually controls the heat source unit, wherein the determination unit determines individual operation of the heat source unit, based on the information indicating the position that is acquired by the image position acquisition unit, wherein the heating control unit individually controls the heat source units based on the determination by the determination unit, wherein if the density of a color of the image that is printed on the sheet is low, the determination unit determines that the heat source unit is operated in such a manner that an amount of heat that is small when compared with a case where the density is high is provided to the sheet, and wherein the heating control unit individually controls the heat source unit based on the determination by the determination unit.

14. The apparatus according to claim 13, further comprising:

a sheet accommodation unit configured to accommodate the sheet, wherein the image acquisition unit is located in a position in which the image that is formed on the sheet which is accommodated in the sheet accommodation unit is optically readable.

15. The apparatus according to claim 13, wherein the image acquisition unit is located in a position in which the image on the sheet is optically readable until the heating unit starts to heat the sheet.

* * * * *